US009865384B2

(12) United States Patent
Jeong et al.

(10) Patent No.: US 9,865,384 B2
(45) Date of Patent: Jan. 9, 2018

(54) REFRIGERATOR

(71) Applicant: Samsung Electronics Co., Ltd., Suwon-si (KR)

(72) Inventors: Jin Jeong, Yongin-si (KR); Kyoung Ki Park, Gwangju (KR); Bong Su Son, Cheonan-si (KR); Do Yun Jang, Busan (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 471 days.

(21) Appl. No.: 14/467,710

(22) Filed: Aug. 25, 2014

(65) Prior Publication Data

US 2015/0061484 A1 Mar. 5, 2015

(30) Foreign Application Priority Data

Aug. 27, 2013 (KR) ..... 10-2013-0101850
Oct. 29, 2013 (KR) ..... 10-2013-0128860

(51) Int. Cl.

| | |
|---|---|
| ***F25D 3/02*** | (2006.01) |
| ***H01F 7/02*** | (2006.01) |
| ***F25C 5/00*** | (2006.01) |
| ***F25C 5/18*** | (2006.01) |
| ***F25D 23/02*** | (2006.01) |
| ***F25D 25/00*** | (2006.01) |

(52) U.S. Cl.

CPC ..... *H01F 7/0205* (2013.01); *F25C 5/005* (2013.01); *F25C 5/182* (2013.01); *F25D 23/02* (2013.01); *F25D 23/021* (2013.01); *F25D 25/005* (2013.01)

(58) Field of Classification Search

CPC ..... H01F 7/0205; F25C 5/005; F25C 5/182; F25C 5/002; F25C 5/007; F25C 5/18; F25D 23/02; F25D 23/021; F25D 25/005

USPC ..... 62/459

See application file for complete search history.

(56) References Cited

U.S. PATENT DOCUMENTS 3,790,197 A * 2/1974 Parker ..... E05C 19/16 292/251.5
7,188,479 B2 * 3/2007 Anselmino ..... F25C 5/005 62/135
7,870,754 B2 * 1/2011 Martin ..... F25C 5/185 292/DIG. 37

(Continued)

FOREIGN PATENT DOCUMENTS

CN 101512259 A 8/2009
CN 103185431 A 7/2013

(Continued)

OTHER PUBLICATIONS

Walaski, EPO Search Report, Mar. 31, 2015.*

(Continued)

*Primary Examiner* — Len Tran
*Assistant Examiner* — Ana Vazquez
(74) *Attorney, Agent, or Firm* — Staas & Halsey LLP

(57) ABSTRACT

A refrigerator including a first magnet provided at an upper end of a cover of an ice bucket and a second magnet provided at a ceiling of an inner liner. The ice bucket is fixed in a state in which the cover of the ice bucket is in tight contact with a front wall of an ice-making compartment due to magnetically attractive force between the first magnet and the second magnet.

9 Claims, 22 Drawing Sheets

(56) References Cited

U.S. PATENT DOCUMENTS

| | | | | |
|---|---|---|---|---|
| 8,484,809 | B2 * | 7/2013 | Fiedler | A45C 13/1069<br>220/230 |
| 2006/0175842 | A1 * | 8/2006 | Saitoh | E05C 19/163<br>292/251.5 |
| 2007/0245762 | A1 * | 10/2007 | Maglinger | F25C 5/005<br>62/344 |
| 2008/0169890 | A1 * | 7/2008 | Irwin | E05B 47/0002<br>335/228 |
| 2011/0026203 | A1 * | 2/2011 | Ligtenberg | E05C 19/16<br>361/679.01 |
| 2013/0075562 | A1 * | 3/2013 | Miklas | B60N 3/107<br>248/286.1 |
| 2013/0192279 | A1 * | 8/2013 | McCollough | F25D 21/08<br>62/66 |

FOREIGN PATENT DOCUMENTS

| | | | | |
|---|---|---|---|---|
| CN | 103363752 | A | 10/2013 | |
| JP | 2000-180036 | * | 6/2000 | F25D 23/02 |
| JP | 2001-147077 | * | 5/2001 | F25D 23/02 |
| KR | 10-2009-0133023 | * | 12/2009 | F25D 23/02 |

OTHER PUBLICATIONS

European Search Report dated Mar. 31, 2015 in corresponding European Patent Application No. 14180693.5.

Chinese Office Action dated Nov. 6, 2017 in related Chinese Application No. 201410429371.

* cited by examiner

REFRIGERATOR

CROSS-REFERENCE TO RELATED APPLICATIONS

This application claims the benefit of Korean Patent Application No. 10-2013-0101850 and No. 10-2013-0128860, filed on Aug. 27 and Oct. 29, 2013, in the Korean Intellectual Property Office, the disclosures of which are incorporated herein by reference.

BACKGROUND

1. Field

Embodiments of the present disclosure relate to an ice bucket locking structure of a refrigerator having an ice-making compartment and an ice bucket.

2. Description of the Related Art

Generally, a refrigerator is an apparatus, including a refrigerating compartment and a freezing compartment to store food and a cool air supply device to generate cool air using evaporation heat of a refrigerant and to supply the cool air to the refrigerating compartment and the freezing compartment, to keep food fresh.

The refrigerator may be provided with an ice-making compartment to make ice. Particularly, for a bottom mounted freezer (BMF) type refrigerator or a French door refrigerator (FDR) type refrigerator, the ice-making compartment is generally provided at one side of the refrigerating compartment such that the ice-making compartment is partitioned from the refrigerating compartment.

Additional cool air different from the cool air supplied to the refrigerating compartment and the freezing compartment is supplied to the ice-making compartment. The ice-making compartment includes an ice-maker to make ice and an ice bucket to store the ice made by the ice-maker. The ice bucket is inserted into or withdrawn from the ice-making compartment through an opening formed at the front of the ice-making compartment. The ice bucket has a cover to tightly cover the opening, when inserted into the ice-making compartment, to prevent leakage of cool air from the ice-making compartment.

Meanwhile, the refrigerator may be further provided with a locking device to fix the ice bucket such that the ice bucket introduced into the ice-making compartment may stably tightly cover the opening. Locking devices using a latch mechanism have been proposed. An example of such locking devices is disclosed in U.S. Pat. No. 7,870,754.

The latch mechanism restricts movement of the ice bucket inserted into ice-making compartment using interference between a latch and a catch. However, the latch mechanism merely restricts movement of the ice bucket and forces the cover of the ice bucket to tightly contact the ice-making compartment.

As a result, a gap may be generated between the cover of the ice bucket and a front wall of the ice-making compartment due to a manufacturing error, an assembly error, or long-term use.

SUMMARY

It is an aspect of the present disclosure to provide a refrigerator having an ice bucket locking device that enables a cover of an ice bucket to be in tight contact with a front wall of an ice-making compartment, thereby fundamentally preventing leakage of cool air.

Additional aspects of the disclosure will be set forth in part in the description which follows and, in part, will be apparent from the description, or may be learned by practice of the disclosure.

In accordance with an aspect of the present disclosure, a refrigerator includes a main body having an inner liner and an outer liner, an ice-making compartment formed in the main body, the ice-making compartment having an opening formed at a front thereof, an ice bucket inserted into or withdrawn from the ice-making compartment through the opening, the ice bucket having a cover to tightly cover the opening to prevent leakage of cool air from the ice-making compartment, a first magnet provided at an upper end of the cover, a button member, at which a second magnet is mounted such that the second magnet magnetically reacts with the first magnet, the button member being provided at a ceiling of the inner liner such that the button member is movable between a closed position at which the second magnet is the closest to the first magnet such that attractive force is generated between the first magnet and the second magnet and an open position at which the second magnet is the farthest from the first magnet such that repulsive force is generated between the first magnet and the second magnet, and an elastic member to elastically bias the button member to the closed position.

The first magnet and the second magnet may each include at least one N pole and at least one S pole alternately arranged in a movement direction of the button member.

The N pole of the first magnet may face the S pole of the second magnet and the S pole of the first magnet may face the N pole of the second magnet at the closed position and the N pole of the first magnet may face the N pole of the second magnet and the S pole of the first magnet may face the S pole of the second magnet at the open position.

The refrigerator may further include a locking device housing to receive the button member and the elastic member, the locking device housing being coupled to the ceiling of the inner liner.

The locking device housing may include a first housing coupled to the ceiling of the inner liner and a second housing coupled to the first housing.

The cover may have a first magnet mounting part, in which the first magnet is mounted.

The button member may have a second magnet mounting part, in which the second magnet is mounted.

The button member may have a push protrusion to push the ice bucket such that the ice bucket is separated from the ice-making compartment when moving from the closed position to the open position.

The push protrusion may have an inclined surface to move the ice bucket in a direction perpendicular to a movement direction of the button member.

The first magnet and the second magnet may be inclined.

The first magnet and the second magnet may be permanent magnets.

The cover may be provided at a rear thereof with a sealing member, made of rubber, contacting the ice-making compartment to achieve airtightness.

In accordance with another aspect of the present disclosure, a refrigerator includes a main body having an inner liner and an outer liner, an ice-making compartment formed in the main body, the ice-making compartment having an opening formed at a front thereof, an ice bucket inserted into or withdrawn from the ice-making compartment through the opening, the ice bucket having a cover to tightly cover the opening to prevent leakage of cool air from the ice-making compartment, a first magnet provided at an upper end of the cover, a button member, at which a second magnet is mounted such that attractive force is generated between the first magnet and the second magnet, the button member being provided at a ceiling of the inner liner such that the button member is movable between a closed position at which the second magnet is the closest to the first magnet such that attractive force between the first magnet and the second magnet is maximized and an open position at which the second magnet is the farthest from the first magnet such the attractive force between the first magnet and the second magnet is minimized, and an elastic member to elastically bias the button member to the closed position.

The first magnet and the second magnet may each include N and S poles arranged in a direction perpendicular to a movement direction of the button member and the first magnet and the second magnet may be disposed such that opposite poles of the first magnet and the second magnet face each other.

In accordance with another aspect of the present disclosure, a refrigerator includes a main body having an inner liner and an outer liner, an ice-making compartment formed in the main body, the ice-making compartment having an opening formed at a front thereof, an ice bucket inserted into or withdrawn from the ice-making compartment through the opening, the ice bucket having a cover to tightly cover the opening to prevent leakage of cool air from the ice-making compartment, a first magnet provided at an upper end of the cover, and a second magnet provided at a ceiling of the inner liner such that the second magnet magnetically reacts with the first magnet to lock the ice bucket.

The ice bucket inserted into the ice-making compartment may be locked by magnetically attractive force between the first magnet and the second magnet.

The refrigerator may further include a locking device housing, in which the second magnet is mounted, coupled to the ceiling of the inner liner.

In accordance with another aspect of the present disclosure, a refrigerator includes a main body having an inner liner and an outer liner, an ice-making compartment formed in the main body, the ice-making compartment having an opening formed at a front thereof, an ice bucket inserted into or withdrawn from the ice-making compartment through the opening, the ice bucket having a cover to tightly cover the opening to prevent leakage of cool air from the ice-making compartment, a magnet provided at any one selected from between an upper end of the cover and a ceiling of the inner liner, and a magnetic material provided at the other selected from between the upper end of the cover and the ceiling of the inner liner such that the magnetic material magnetically reacts with the magnet.

In accordance with a further aspect of the present disclosure, a refrigerator includes a main body having an inner liner and an outer liner, an ice-making compartment formed in the main body, the ice-making compartment having an opening formed at a front thereof, an ice bucket inserted into or withdrawn from the ice-making compartment through the opening, the ice bucket having a cover to tightly cover the opening to prevent leakage of cool air from the ice-making compartment, a sealing member, made of rubber, provided at a rear of the cover such that the sealing member contacts a front wall of the ice-making compartment to achieve air-tightness, a first magnet provided at an upper end of the cover, and a second magnet provided at the front wall of the ice-making compartment such that the second magnet magnetically reacts with the first magnet to lock the ice bucket.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
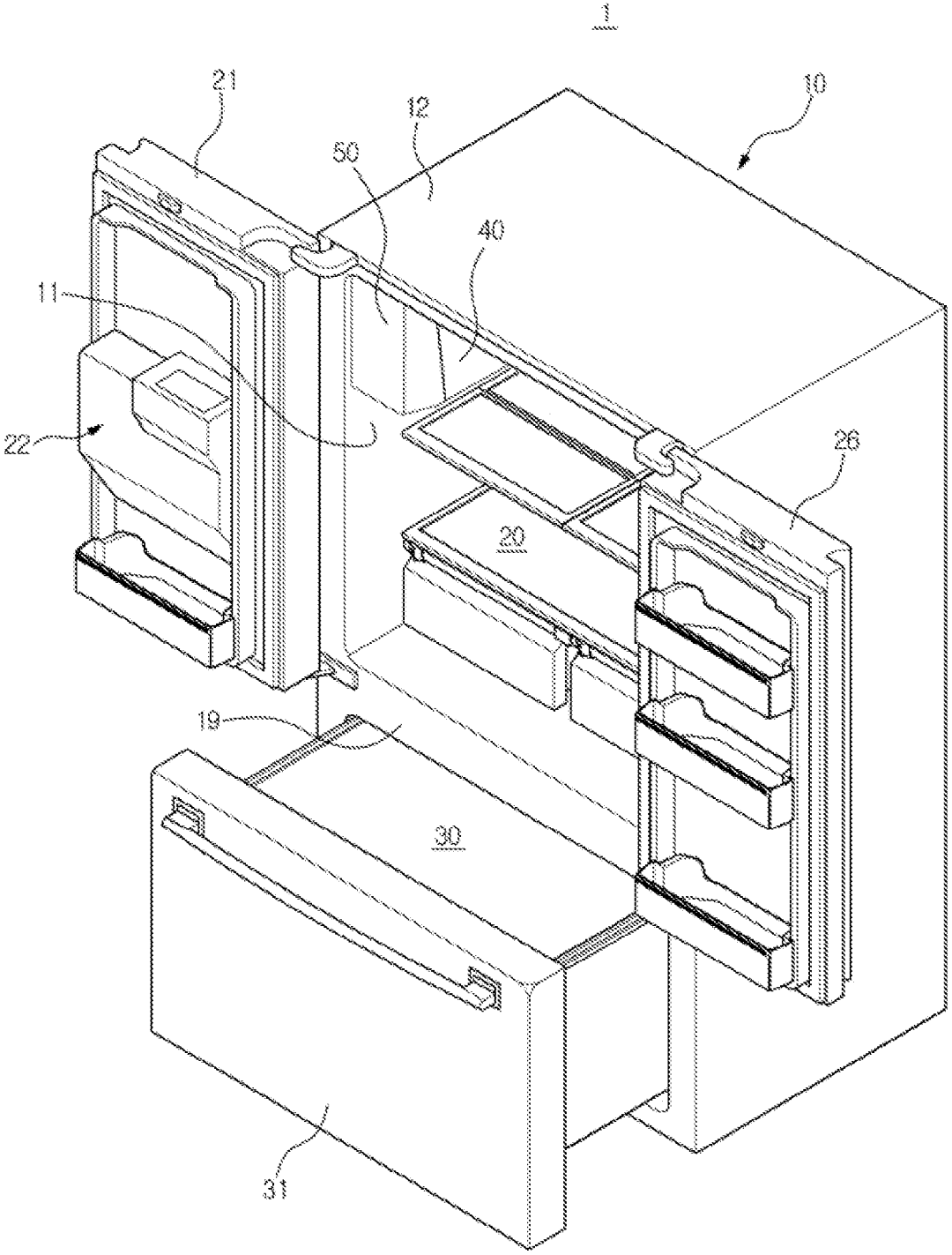
FIG. 1 is a view showing the external appearance of a refrigerator according to an embodiment of the present disclosure.

Reference will now be made in detail to the embodiments of the present disclosure, examples of which are illustrated in the accompanying drawings, wherein like reference numerals refer to like elements throughout.

Figure 2:
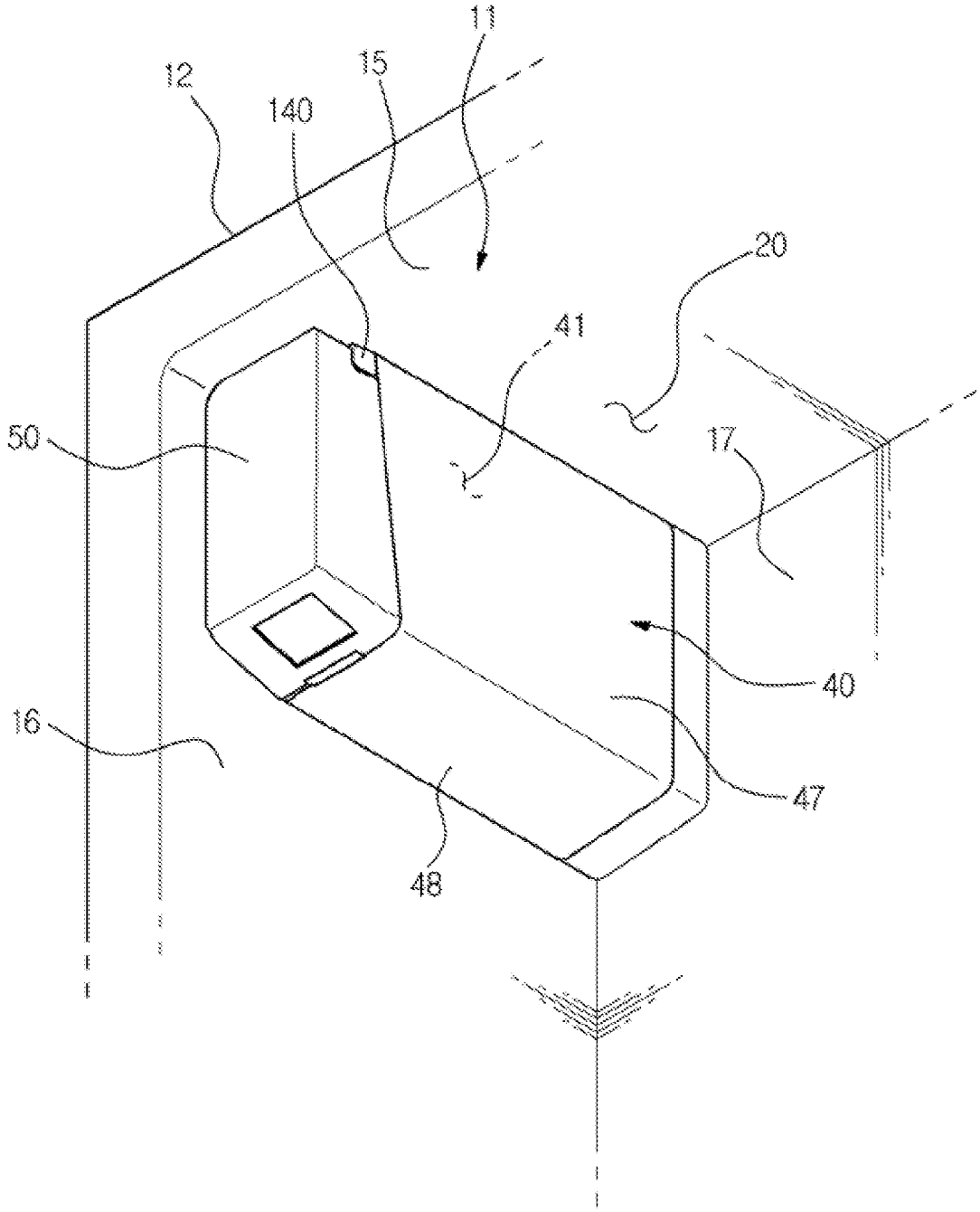
FIG. 2 is a view showing a state in which an ice bucket is mounted in an ice-making compartment of the refrigerator of FIG. 1.
Figure 3:
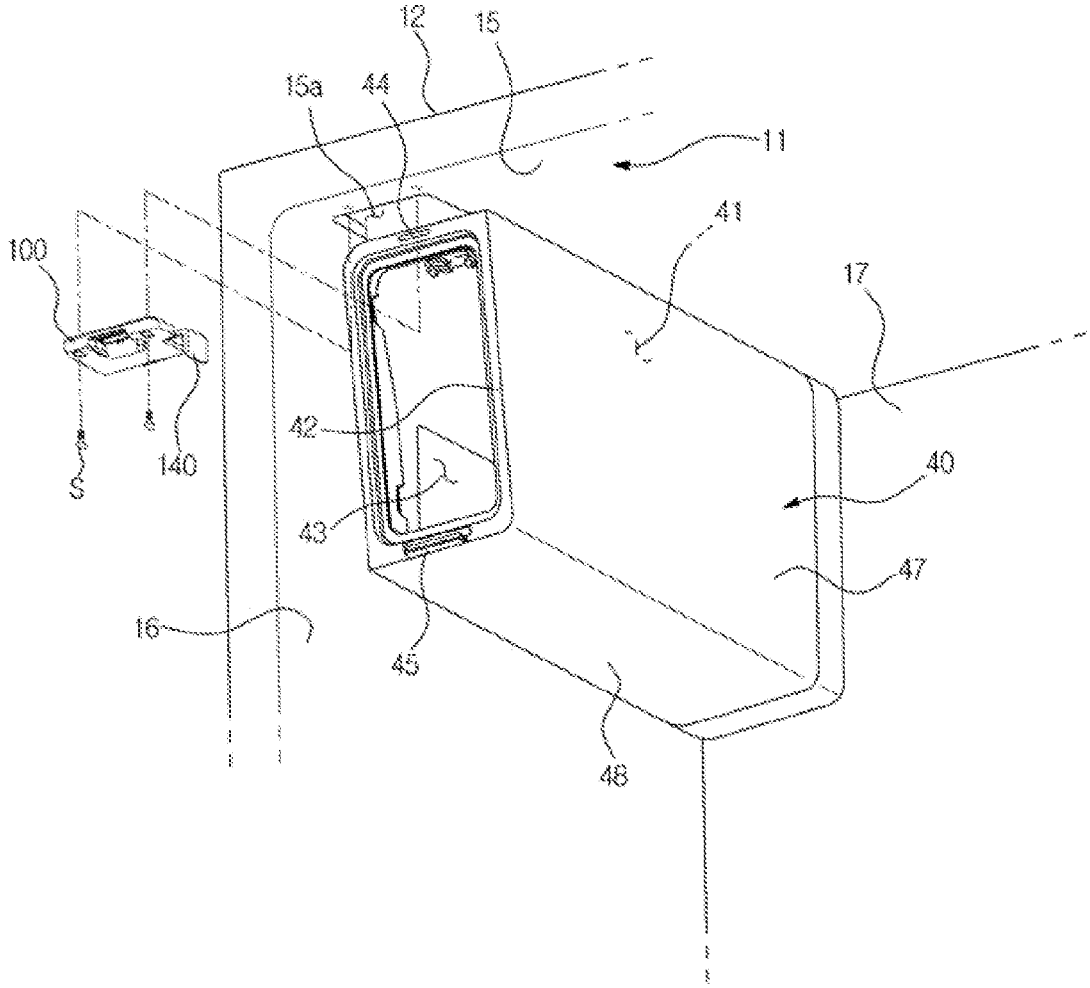
FIG. 3 is a view showing a state in which the ice bucket is separated from the ice-making compartment of the refrigerator of FIG. 1.
Figure 4:
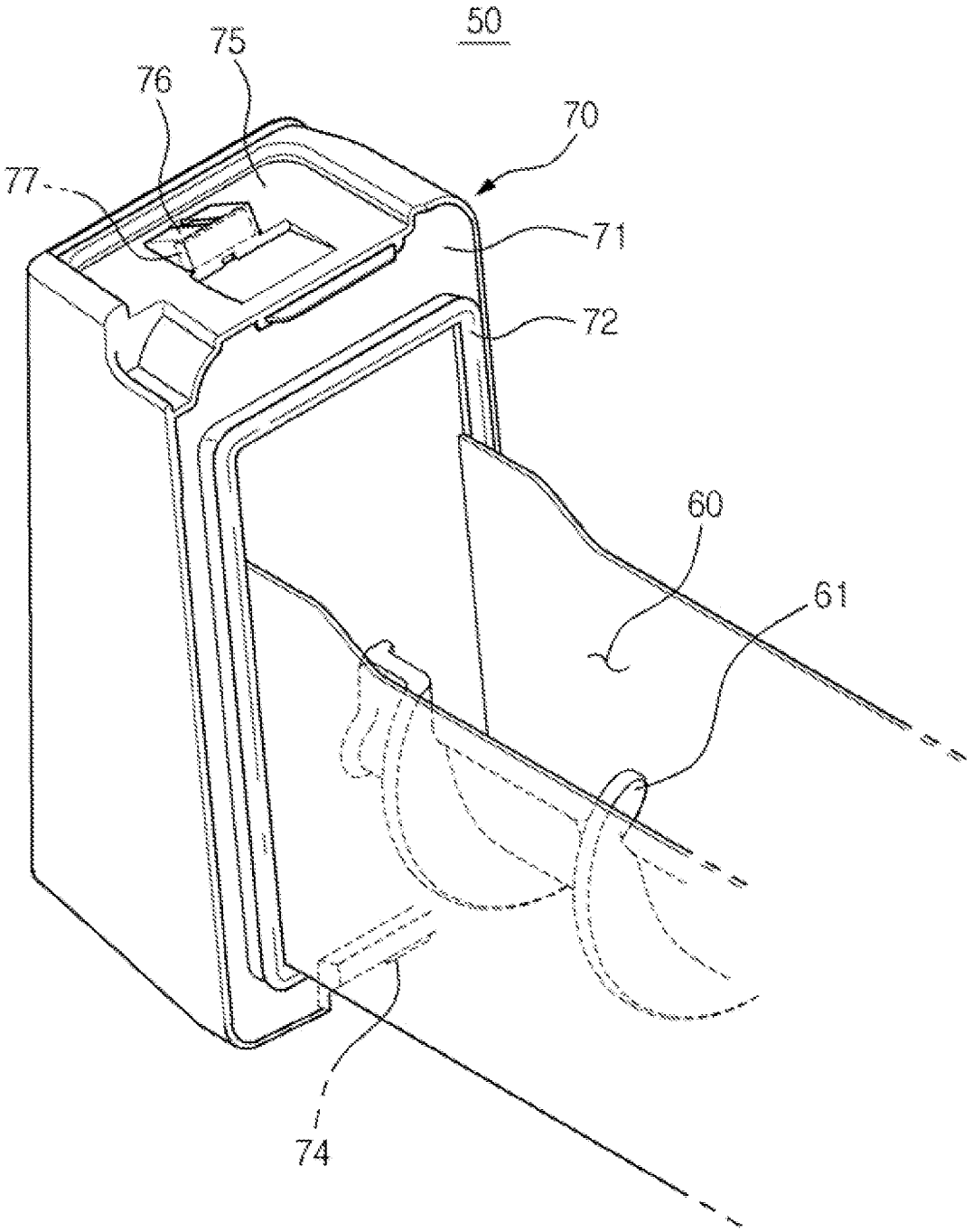
FIG. 4 is a view showing the ice bucket of FIG. 1.
Figure 5:
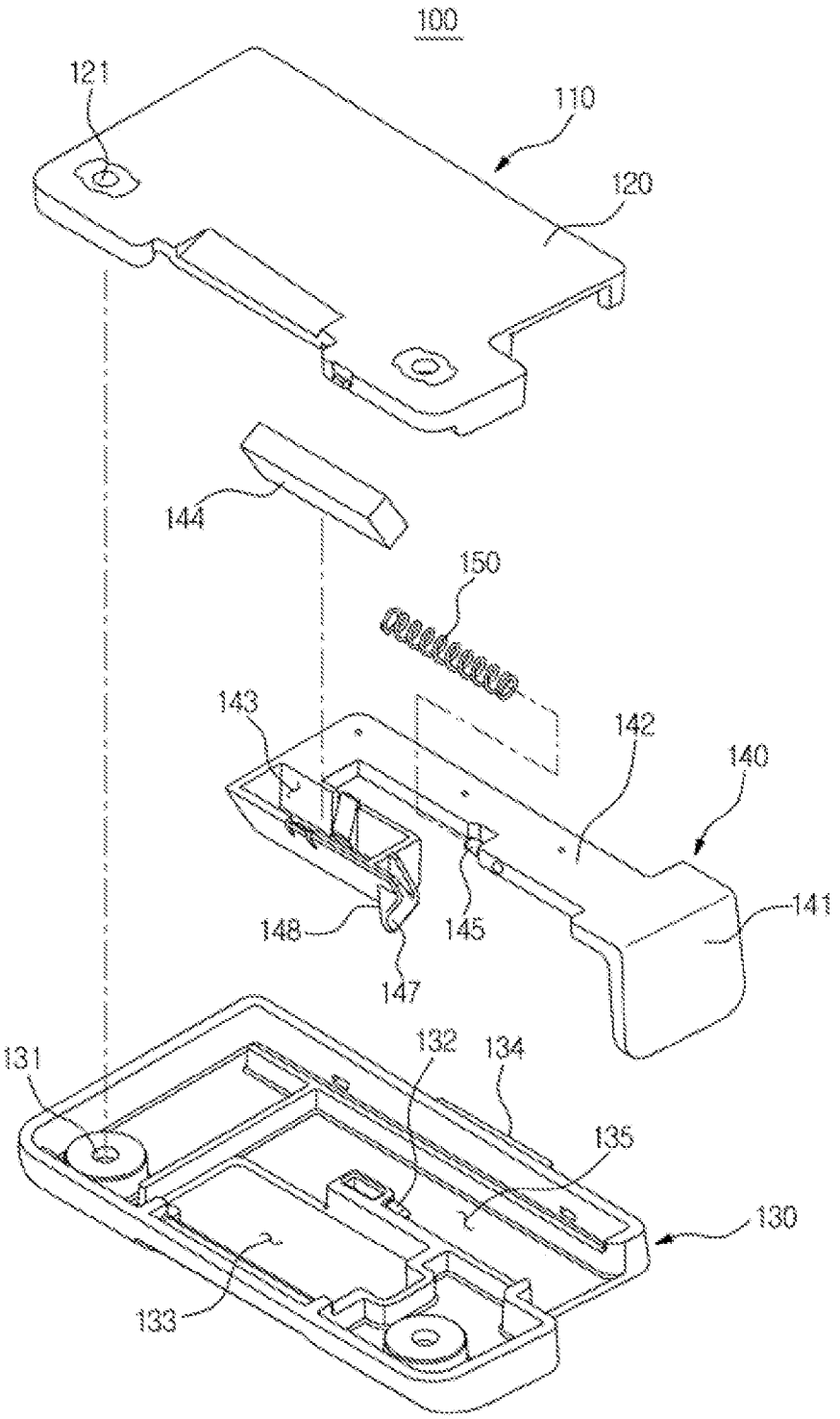
FIG. 5 is an exploded perspective view showing a locking device of the ice bucket of the refrigerator of FIG. 1.
Figure 6:
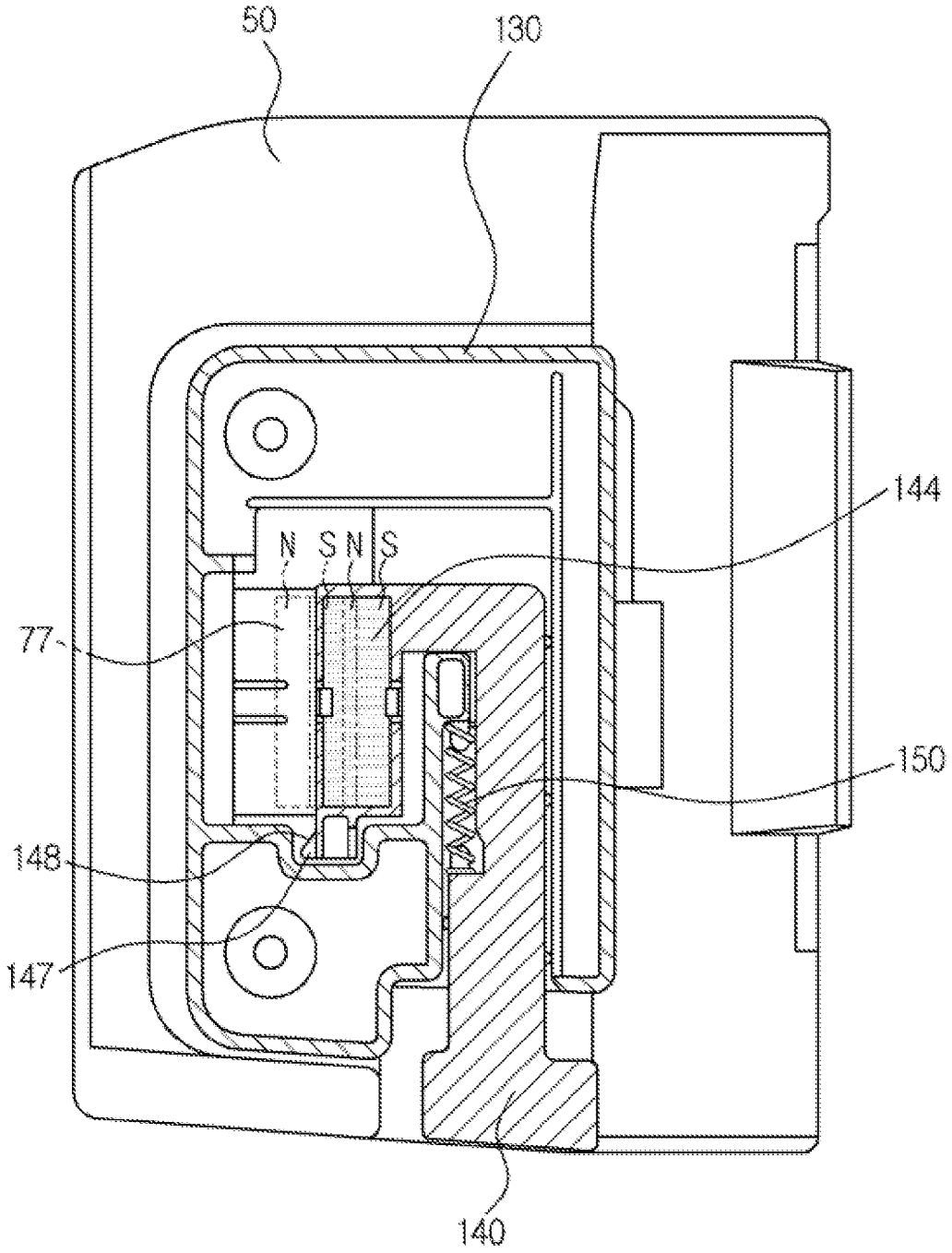
FIG. 6 is a plan sectional view showing a state in which the ice bucket of the refrigerator of FIG. 1 is locked.
Figure 7:
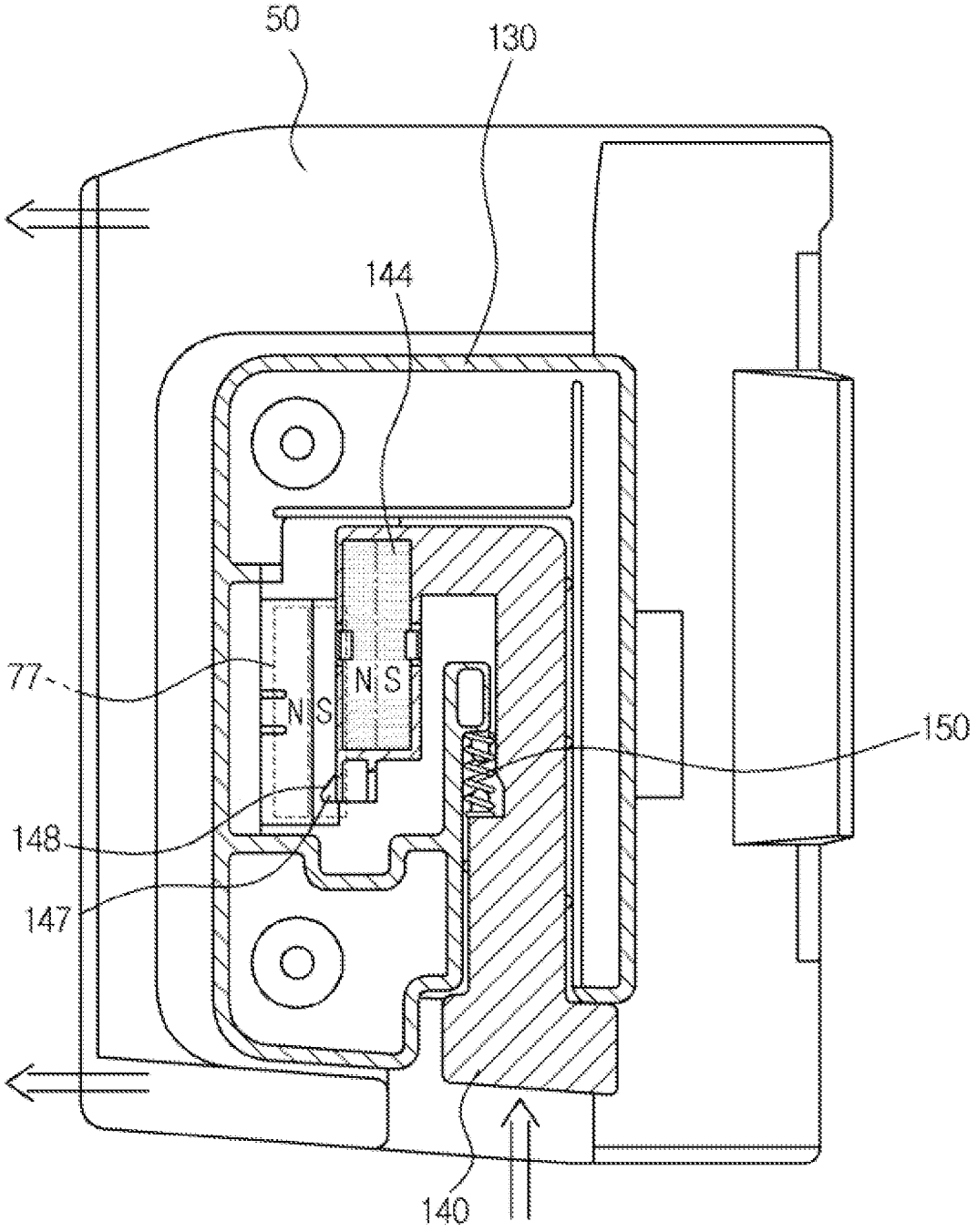
FIG. 7 is a plan sectional view showing a state in which a button member is pushed to unlock the ice bucket of the refrigerator of FIG. 1.
Figure 8:
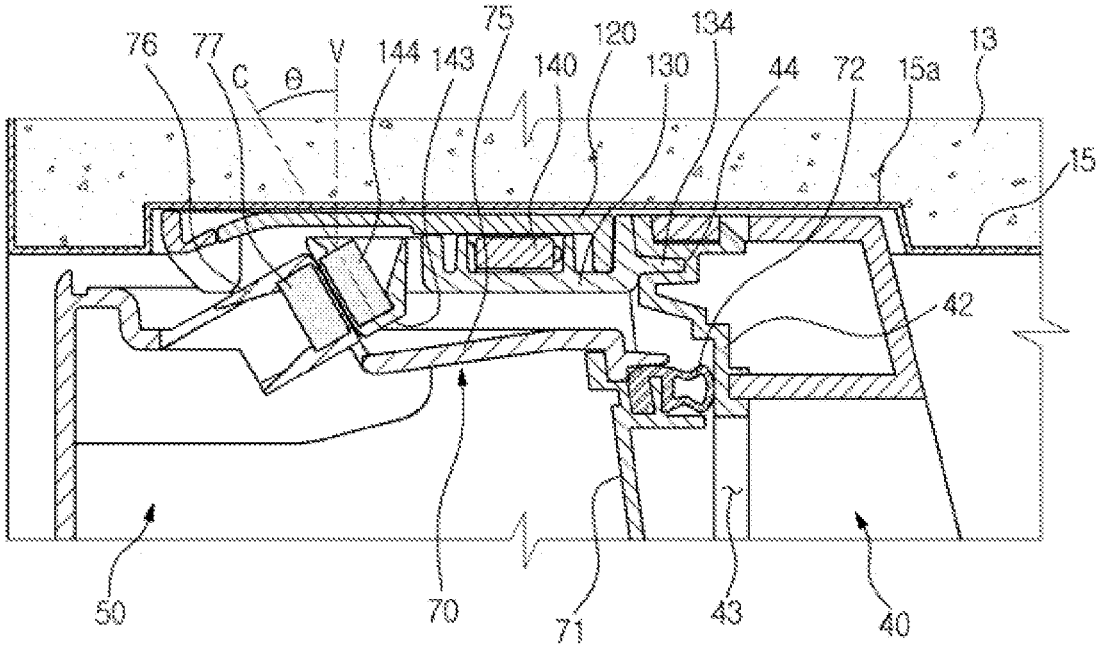
FIG. 8 is a side sectional view showing a state in which the ice bucket of the refrigerator of FIG. 1 is locked.
Figure 9:
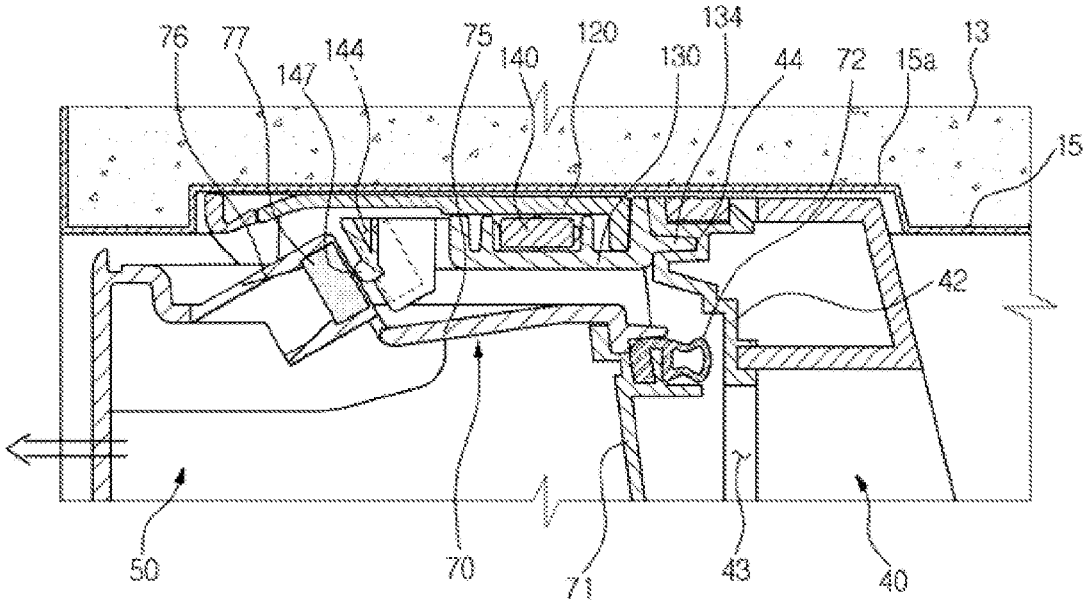
FIG. 9 is a side sectional view showing a state in which the button member is pushed to unlock the ice bucket of the refrigerator of FIG. 1.

FIG. 1 is a view showing the external appearance of a refrigerator according to an embodiment of the present disclosure. FIG. 2 is a view showing a state in which an ice bucket is mounted in an ice-making compartment of the refrigerator of FIG. 1 and FIG. 3 is a view showing a state in which the ice bucket is separated from the ice-making compartment of the refrigerator of FIG. 1. FIG. 4 is a view showing the ice bucket of FIG. 1 and FIG. 5 is an exploded perspective view showing a locking device of the ice bucket of the refrigerator of FIG. 1. FIG. 6 is a plan sectional view showing a state in which the ice bucket of the refrigerator of FIG. 1 is locked and FIG. 7 is a plan sectional view showing a state in which a button member is pushed to unlock the ice bucket of the refrigerator of FIG. 1. FIG. 8 is a side sectional view showing a state in which the ice bucket of the refrigerator of FIG. 1 is locked and FIG. 9 is a side sectional view showing a state in which the button member is pushed to unlock the ice bucket of the refrigerator of FIG. 1.

Referring to FIGS. 1 to 5, a refrigerator 1 includes a main body 10, storage compartments 20 and 30 defined in the main body 10 to store food, an ice-making compartment 40 disposed at one corner of the upper part of the storage compartment to make ice, and a cool air supply device (not shown) to generate cool air and to supply the cool air to the storage compartments 20 and 30 and the ice-making compartment 40.

The main body 10 includes an inner liner 11 having the storage compartments 20 and 30 and the ice-making compartment 40 defined therein, an outer liner 12 coupled to the outside of the inner liner 11, the outer liner 12 forming the external appearance of the refrigerator 1, and an insulating material 13 (see FIG. 8) provided between the inner liner 11 and the outer liner 12 to insulate the storage compartments 20 and 30 and the ice-making compartment 40 from the outside.

The storage compartments 20 and 30 include a refrigerating compartment 20 to store food in a refrigerated state and a freezing compartment 30 disposed below the refrigerating compartment 20 to store food in a frozen state. The refrigerating compartment 20 and the freezing compartment 30 may be partitioned from each other by an intermediate partition 19.

The refrigerating compartment 20 may be opened and closed by a pair of doors 21 and 26 hinged to the main body 10. The freezing compartment 30 may be opened and closed by a sliding door 31 slidably coupled to the main body 10.

At one of the doors 21 and 26, e.g. the door 21, may be provided a dispenser 22 to discharge ice generated by the ice-making compartment 40. A user may take ice from the ice-making compartment 40 through the dispenser 22 without opening the doors 21 and 26.

As shown in FIGS. 2 and 3, the ice-making compartment 40 may be provided at one corner of the upper part of the refrigerating compartment 20. The ice-making compartment 40 may include an inner space 41, an ice-making compartment front wall 42, an ice-making compartment side wall 47, and an ice-making compartment bottom wall 48. The inner space 41 of the ice-making compartment 40 may be defined by the ice-making compartment front wall 42, the ice-making compartment side wall 47, the ice-making compartment bottom wall 48, a side wall 16 of the inner liner 11 of the refrigerating compartment 20, a ceiling 15 of the inner liner 11 of the refrigerating compartment 20, and a rear wall 17 of the inner liner 11 of the refrigerating compartment 20.

The ice-making compartment front wall 42, the ice-making compartment side wall 47, and the ice-making compartment bottom wall 48 may be integrated. In the ice-making compartment front wall 42, the ice-making compartment side wall 47, and the ice-making compartment bottom wall 48 may be provided an ice-making compartment insulating material (not shown) to insulate the ice-making compartment 40. The ice-making compartment front wall 42, the ice-making compartment side wall 47, and the ice-making compartment bottom wall 48 may be provided separately from the inner liner 11 of the refrigerating compartment 20 and then coupled to the inner liner 11 of the refrigerating compartment 20.

In the ice-making compartment front wall 42 is formed an opening 43, through which an ice bucket 50 is inserted into and withdrawn from the inner space 41. The opening 43 may be formed in an appropriate rectangular shape. In addition, an auxiliary catching protrusion 45 to fix the ice bucket 50 may be provided at the lower end of the ice-making compartment front wall 42.

In the inner space 41 of the ice-making compartment 40 may be disposed an ice-making tray (not shown), having an ice-making cell to receive water, to make ice. In the ice-making compartment 40 may be inserted a refrigerant pipe to directly cool the ice-making tray (not shown) in contact with the ice-making tray (not shown).

As shown in FIG. 4, the ice bucket 50 includes a basket 60 to store ice made by the ice-making tray (not shown) and a cover 70 provided at the front of the basket 60 to close the opening 43 of the ice-making compartment 40 when the ice bucket 50 is introduced into the ice-making compartment 40.

The basket 60 has a sufficient size to pass through the opening 43 of the ice-making compartment 40. The basket 60 is open at the top thereof to receive ice falling from the ice-making tray (not shown). In the basket 60 may be provided an auger 61 to convey ice received in the basket 60 forward.

The cover 70 has a larger size than the opening 43 of the ice-making compartment 40. The cover 70 is disposed outside the ice-making compartment 40 to cover the opening 43 of the ice-making compartment 40. At the rear 71 of the cover 70 may be provided a sealing member 72, made of rubber, contacting the ice-making compartment front wall 42 to achieve airtightness. The sealing member 72 may be formed in an appropriate rectangular shape corresponding to the edge of the opening 43.

At the lower end of the rear 71 of the cover 70 may be provided a lower protrusion 74 interfering with the catching protrusion 45 of the ice-making compartment front wall 42 to fix the ice bucket 50.

The lower protrusion 74 provided at the lower end of the ice bucket 50 and the catching protrusion 45 provided at the lower end of the ice-making compartment 40 function to fix the lower end of the ice bucket 50. Magnets 77 and 144, which will be described hereinafter, function to fix the upper end of the ice bucket 50 in tight contact.

When the ice bucket 50 is slightly lifted up and then put down during introduction of the ice bucket 50, the lower protrusion 74 of the ice bucket 50 and the catching protrusion 45 of the ice-making compartment 40 may interfere with each other. When the ice bucket 50 is slightly lifted up during withdrawal of the ice bucket 50, interference between the lower protrusion 74 of the ice bucket 50 and the catching protrusion 45 of the ice-making compartment 40 may be released.

At the upper end 75 of the cover 70 is provided a first magnet 77 to enable the cover 70 to tightly contact the ice-making compartment front wall 42 and to lock the ice bucket 50. The first magnet 77 may be a permanent magnet, such as a neodymium magnet, a ferrite magnet, or an alnico magnet.

At the upper end 75 of the cover 70 may be provided a first magnet mounting part 76, in which the first magnet 77 is mounted. The first magnet mounting part 76 may have a groove shape. The first magnet 77 may be received and mounted in the first magnet mounting part 76.

At the ceiling 15 of the inner liner 11 may be provided a second magnet 144 corresponding to the first magnet 77 of the cover 70. The second magnet 144 may be a permanent magnet like the first magnet 77.

The first magnet 77 and the second magnet 144 may magnetically attract each other. That is, attractive force may be generated between the first magnet 77 and the second magnet 144.

Specifically, as shown in FIGS. 6 and 7, the first magnet 77 and the second magnet 144 may be disposed such that N and S poles are arranged in a direction perpendicular to the longitudinal direction, i.e. a direction perpendicular to a movement direction of a button member 140, and opposite poles of the first magnet 77 and the second magnet 144 face each other.

Alternatively, the poles of the first magnet 77 and the second magnet 144 may be alternately arranged in the longitudinal direction. This construction corresponds to another embodiment shown in FIGS. 10 and 11, which will hereinafter be described in detail.

As shown in FIG. 5, a locking device 100 includes the second magnet 144, a button member 140 movable between a closed position and an open position, the second magnet 144 being mounted in the button member 140, an elastic member 150 to elastically bias the button member 140 to the closed position, and a locking device housing 110 to receive the button member 140 and the elastic member 150.

The locking device housing 110 includes a first housing 120 coupled to portion 15*a* of the ceiling 15 of the inner liner 11 and a second housing 130 coupled to the lower part of the first housing 120. The first housing 120 and the second housing 130 may be provided with screw fastening holes 121 and 131 through which the first housing 120 and the second housing 130 are coupled to each other and, in addition, coupled to the ceiling 15 of the inner liner 11. Screws S may be coupled into the screw fastening holes 121 and 131.

At the second housing 130 may be provided a button member receiving part 135, in which the button member 140 is movably received, an insertion protrusion 134 coupled to the ice-making compartment front wall 42, an opening 133, through which a second magnet mounting part 143 of the button member 140 is exposed, and a spring support part 132 to support one end of the elastic member 150. The insertion protrusion 134 may be inserted into an insertion groove 44 of the ice-making compartment front wall 42. The insertion protrusion 134 and the insertion groove 44 may function to adjust a screw coupling position of the locking device housing 110.

The button member 140 may include a body 142, a manipulator 141 formed at one end of the body 142, the manipulator 141 being exposed out of the locking device housing 110 such that the manipulator 141 may be pushed by a user, a second magnet mounting part 143, formed at the other end of the body 142, in which the second magnet 144 is mounted, and a spring support part 145 to support the other end of the elastic member 150.

The second magnet mounting part 143 may have a groove shape. The second magnet 144 may be received and mounted in the second magnet mounting part 143.

The button member 140 may be movable between the closed position and the open position. The closed position is a position at which the second magnet 144 mounted at the button member 140 is the closest to the first magnet 77 mounted at the cover 70 of the ice bucket 50 (see FIGS. 6 and 8). The open position is a position at which the second magnet 144 mounted at the button member 140 is the farthest from the first magnet 77 mounted at the cover 70 of the ice bucket 50 (see FIGS. 7 and 9). The movement direction of the button member 140 may be perpendicular to a direction in which the ice bucket 50 is inserted and withdrawn.

When the button member 140 is at the closed position, therefore, attractive force between the first magnet 77 and the second magnet 144 is maximized with the result that the ice bucket 50 is locked.

When the button member 140 is at the open position, on the other hand, attractive force between the first magnet 77 and the second magnet 144 is minimized. In this state, a user may manually withdraw the ice bucket 50 using force greater than the magnetic force.

The elastic member 150 elastically supports the button member 140 such that the button member 140 is at the closed position. In order to move the button member 140 to the open position, the user may push the manipulator 141 of the button member 140 using force greater than the elastic force of the elastic member 150. The elastic member 150 may be a compression coil spring.

When the ice bucket 50 is inserted into the ice-making compartment 40, therefore, the first magnet 77 provided at the cover 70 of the ice bucket 50 and the second magnet 144 provided at the button member 140 magnetically attract each other with the result that the ice bucket 50 is locked.

At this time, the cover 70 of the ice bucket 50 comes into tight contact with the front wall 42 of the ice-making compartment 40 due to magnetic forces of the first magnet 77 and the second magnet 144. That is, the ice bucket 50 is fixed in a state in which the cover 70 is in tight contact with the front wall 42 of the ice-making compartment 40 due to attractive force between the first magnet 77 and the second magnet 144.

In a fixing structure of the ice bucket using a conventional latch mechanism, only the movement of the ice bucket is restricted with the result that there may be a gap between the cover of the ice bucket and the ice-making compartment. On the other hand, the locking device using the magnetic forces of the magnets according to the embodiment of the present disclosure enables the cover of the ice bucket to be in tight contact with the ice-making compartment, thereby fundamentally preventing leakage of cool air from the ice-making compartment.

In order to withdraw the ice bucket 50, which is locked by the magnetic forces, the button member 140 may be pushed such that the button member 140 moves to the open position. When the button member 140 moves to the open position, the distance between the first magnet 77 and the second magnet 144 is increased with the result that the magnetically attractive force between the first magnet 77 and the second magnet 144 may decrease. In this state, the user may pull the ice bucket 50 to easily withdraw the ice bucket 50.

Meanwhile, the button member 140 may be further provided with a push protrusion 147 provided for the user to more easily withdraw the ice bucket 50. The push protrusion 147 may be pushed in a direction in which the ice bucket 50 is separated when the button member 140 moves from the closed position to the open position.

Since the movement direction of the button member 140 is perpendicular to the insertion and withdrawal direction of the ice bucket 50, the push protrusion 147 may have an inclined surface 148 to transmit force in a direction perpendicular to the movement direction of the button member 140.

Meanwhile, the first magnet 77 and the second magnet 144 may each be formed in a rectangular hexahedral shape. The first magnet 77 and the second magnet 144 may be somewhat spaced apart from each other to prevent difficulty in separation of the ice bucket due to excessive attractive force therebetween. The first magnet 77 and the second magnet 144 may be inclined.

That is, as shown in FIG. 8, the second magnet 144 may be disposed such that the central axis C of the second magnet 144 is at a predetermined angle θ to a virtual perpendicular axis V. As the first magnet 77 and the second magnet 144 are inclined, spaces occupied by the magnets in the vertical direction are minimized while working areas of the magnets are increased.

Locking and unlocking of the ice bucket according to this embodiment will be described with reference to FIGS. 6 to 9.

When the ice bucket 50 is inserted into the ice-making compartment 40 through the opening 43, the ice bucket 50 is fixed in a state in which the cover 70 is in tight contact with the ice-making compartment 40 due to the magnetically attractive force between the first magnet 77 mounted at the cover 70 of the ice bucket 50 and the second magnet 144 mounted at the button member 140. At this time, the button member 140 is located at the closed position at which the second magnet 144 is the closest to the first magnet 77 and the attractive force between the first magnet 77 and the second magnet 144 is maximized.

When the push button 140 is pushed to withdraw the ice bucket 50 from the ice-making compartment 40, the push button 140 moves from the closed position to the open position. At the open position, the second magnet 144 is the farthest from the first magnet 77 and thus the attractive force between the first magnet 77 and the second magnet 144 is minimized. In this state, a user may pull the ice bucket 50 to easily withdraw the ice bucket 50.

At this time, the push protrusion 147 of the button member 140 mechanically pushes the ice bucket 50 in the withdrawal direction. As a result, the ice bucket 50 may be more easily separated.

Figure 10:
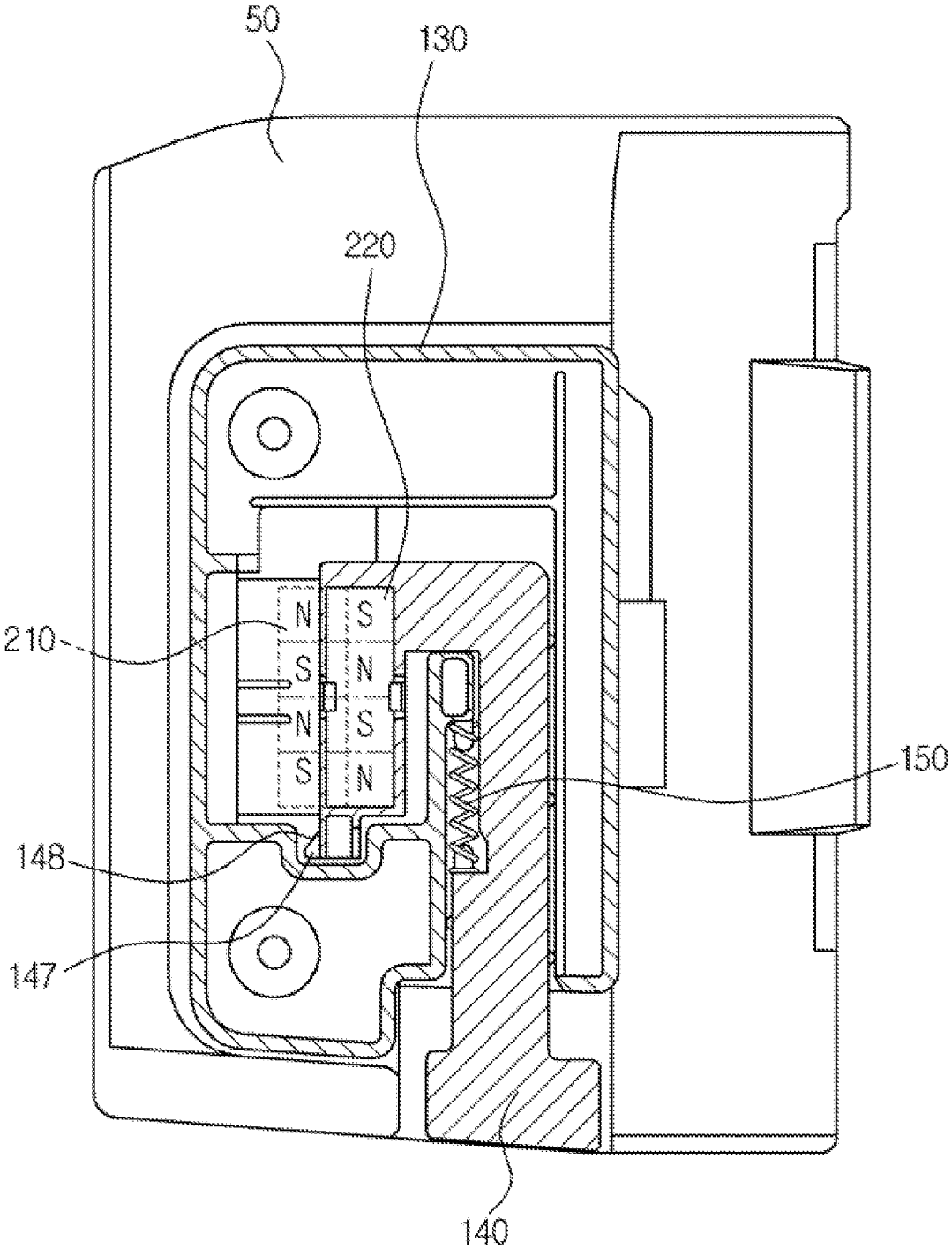
FIG. 10 is a plan sectional view showing a state in which a button member of a refrigerator according to another embodiment of the present disclosure is at a closed position.
Figure 11:
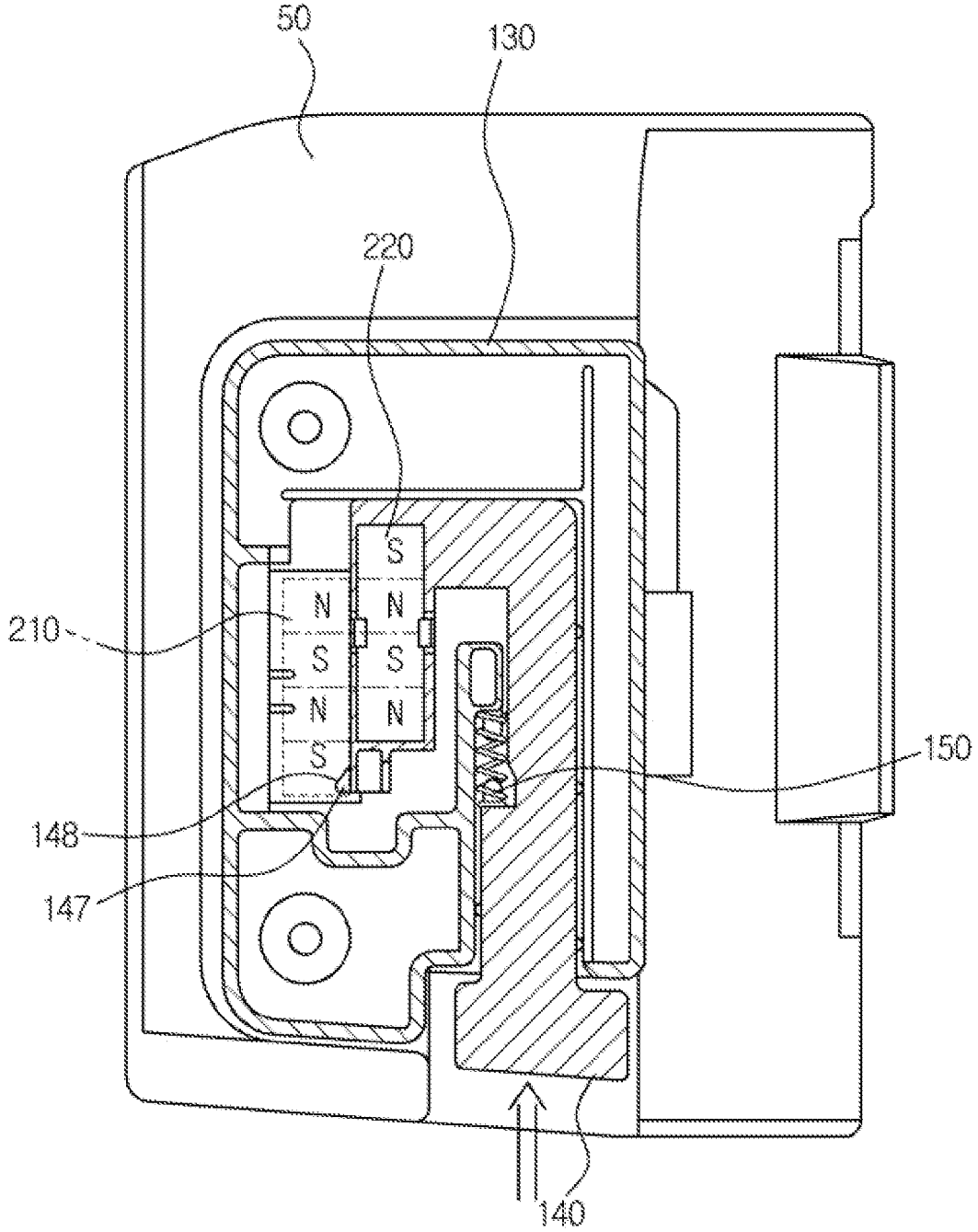
FIG. 11 is a plan sectional view showing a state in which the button member of the refrigerator of FIG. 10 is at an open position.

FIG. 10 is a plan sectional view showing a state in which a button member of a refrigerator according to another embodiment of the present disclosure is at a closed position and FIG. 11 is a plan sectional view showing a state in which the button member of the refrigerator of FIG. 10 is at an open position.

A locking structure of an ice bucket of the refrigerator according to this embodiment will be described with reference to FIGS. 10 and 11. The same components of this embodiment as the previous embodiment are denoted by the same reference numerals and a description thereof may be omitted.

A first magnet 210 provided at an ice bucket 50 and a second magnet 220 provided at the ceiling of an inner liner may be configured such that at least one N pole and at least one S pole are alternately arranged in the longitudinal direction. The longitudinal direction of the first magnet 210 and the second magnet 220 is the same direction as the movement direction of a button member 140.

In this embodiment, the first magnet 210 and the second magnet 220 each have two N poles and two S poles. However, embodiments of the present disclosure are not limited thereto. For example, the first magnet 210 and the second magnet 220 may each have one N pole and one S pole or three or more N poles and three or more S poles.

When the first magnet 210 and the second magnet 220 are located at a closed position, as shown in FIG. 10, the N poles of the first magnet 210 may adjacently face the S poles of the second magnet 220 and the S poles of the first magnet 210 may adjacently face the N poles of the second magnet 220. At the closed position, therefore, attractive force may be generated between the first magnet 210 and the second magnet 220.

When the first magnet 210 and the second magnet 220 are located at an open position, as shown in FIG. 11, the N poles of the first magnet 210 may adjacently face the N poles of the second magnet 220 and one S pole of the first magnet 210 may adjacently face a corresponding S pole of the second magnet 220.

At the open position, therefore, repulsive force may be generated between the first magnet 210 and the second magnet 220. As a result, a user may easily withdraw the ice bucket 50 using less force.

In this embodiment, the first magnet 210 and the second magnet 220 each have two N poles and two S poles. When the button member 140 moves about ¼ the length of the first magnet 210 and the second magnet 220, therefore, the button member 140 may move from the closed position to the open position or from the open position to the closed position.

Figure 12:
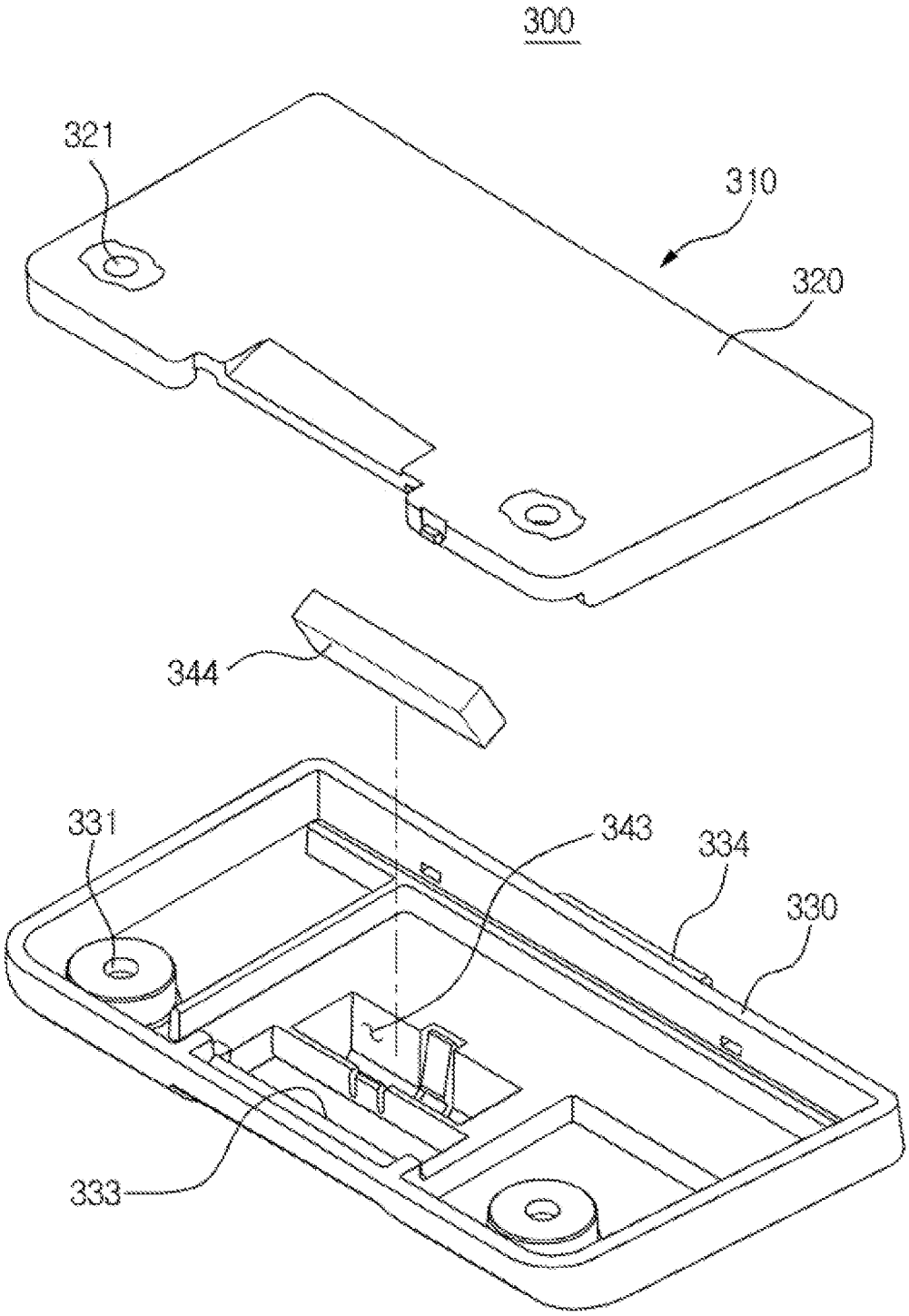
FIG. 12 is an exploded perspective view showing a locking device of an ice bucket of a refrigerator according to another embodiment of the present disclosure.
Figure 13:
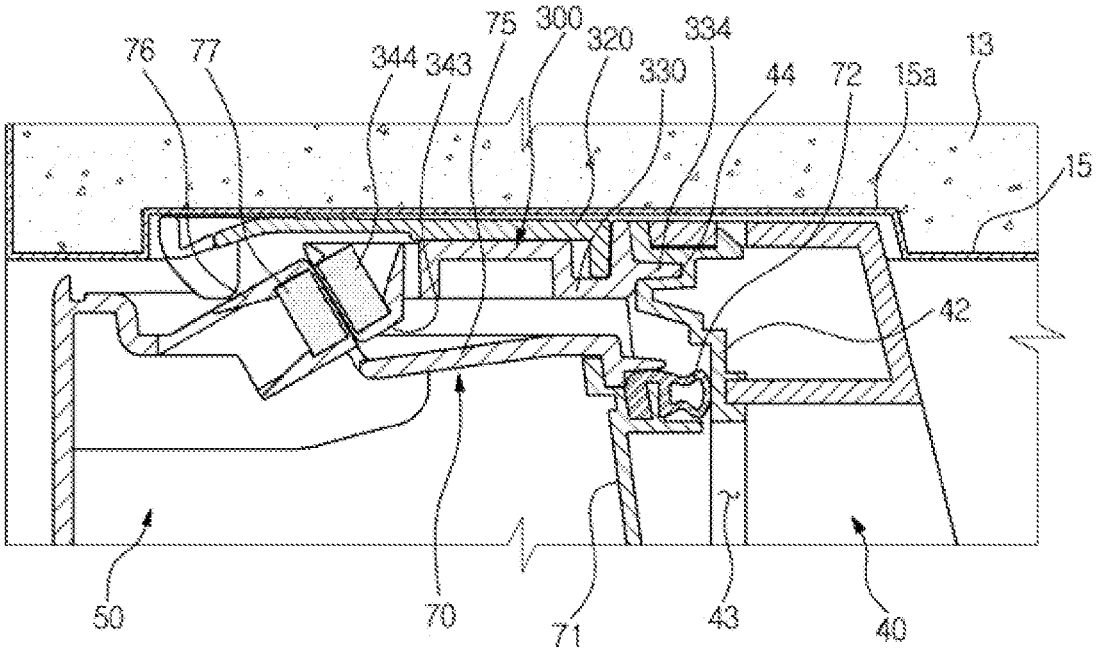
FIG. 13 is a side sectional view showing a state in which the ice bucket of the refrigerator of FIG. 12 is locked.

FIG. 12 is an exploded perspective view showing a locking device of an ice bucket of a refrigerator according to another embodiment of the present disclosure and FIG. 13 is a side sectional view showing a state in which the ice bucket of the refrigerator of FIG. 12 is locked.

The locking device of the ice bucket of the refrigerator according to this embodiment will be described with reference to FIGS. 12 and 13. The same components of this embodiment as the previous embodiment are denoted by the same reference numerals and a description thereof may be omitted.

The locking device 300 includes a locking device housing 310 constituted by a first housing 320 and a second housing 330 coupled to the first housing 320 and a second magnet 344 mounted at the locking device housing 310.

The first housing 320 and the second housing 330 may have screw fastening holes 321 and 331 for coupling. The second housing 330 may be provided with a second magnet mounting part 343, in which the second magnet 344 is mounted, and an opening 333, through which the second magnet mounting part 343 is exposed. The second housing 330 may be further provided with an insertion protrusion 334, which is inserted into an insertion groove 44 of an ice-making compartment front wall 42.

The second magnet mounting part 343 may have a groove shape. The second magnet 344 may be received and mounted in the second magnet mounting part 343.

The construction of a cover of the ice bucket including a first magnet is identical to that of the previous embodiment.

That is, in the locking device of the refrigerator according to this embodiment, the position of the second magnet 344 is fixed. When the ice bucket 50 is inserted into an ice-making compartment 40, the ice bucket 50 is fixed in a state in which the cover 70 is in tight contact with the ice-making compartment 40 due to magnetic forces of the first magnet 77 and the second magnet 344.

In order to withdraw the ice bucket 50, a user may pull the ice bucket 50 using force greater than magnetically attractive force between the first magnet 77 and the second magnet 344.

Figure 14:
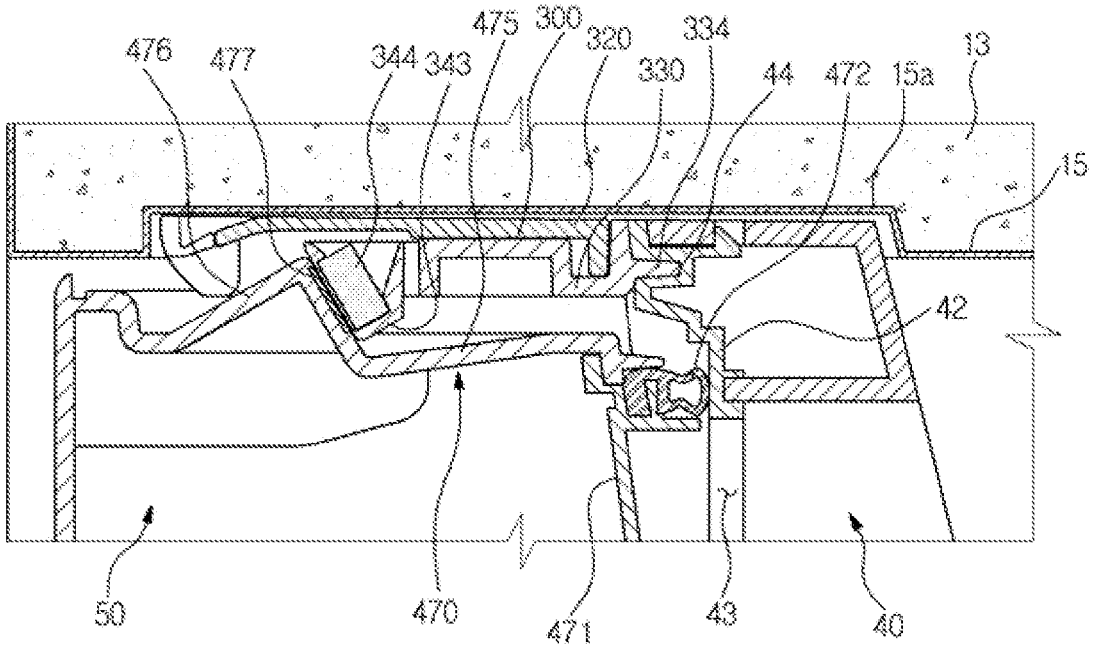
FIG. 14 is a side sectional view showing a state in which an ice bucket of a refrigerator according to another embodiment of the present disclosure is locked.

FIG. 14 is a side sectional view showing a state in which an ice bucket of a refrigerator according to another embodiment of the present disclosure is locked.

A locking structure of the ice bucket according to this embodiment will be described with reference to FIG. 14. The same components of this embodiment as the previous embodiment of FIGS. 12 and 13 are denoted by the same reference numerals and a description thereof may be omitted.

In the previous embodiment of FIGS. 12 and 13, the magnets 77 and 344 are provided at the cover 70 of the ice bucket 50 and the locking device 300 of the inner liner ceiling 15 such that the ice bucket 50 is fixed due to the magnetic forces. In this embodiment, on the other hand, a magnetic material 477 is provided at an upper end 475 of the cover 470 of the ice bucket 50.

The magnetic material 477 may be a material responsive to the magnetic force of a magnet. For example, the magnetic material 477 may include iron, cobalt, or nickel.

At the cover 470 of the ice bucket 50 may be provided a magnetic material mounting part 476, in which the magnetic material 477 is mounted. Alternatively, a portion of the cover 470 of the ice bucket 50 may be formed of a magnetic material.

The other construction including a sealing member 472 provided at the rear 471 of the cover 470 of the ice bucket 50 is identical to that of the previous embodiment of FIGS. 12 and 13.

In this embodiment, only one magnet is used with the result that force to fix the ice bucket 50 may somewhat decrease. However, the locking structure may be simplified. Meanwhile, although not shown, a magnet may be provided at the cover of the ice bucket and a magnetic material may be provided at the locking device of the inner liner ceiling.

Figure 15:
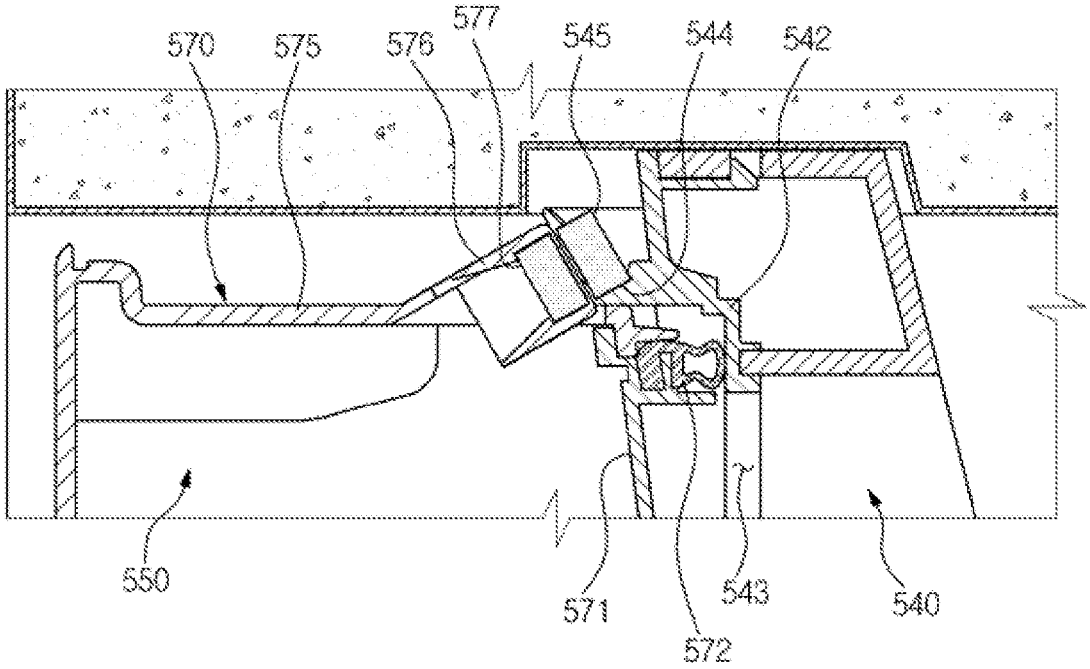
FIG. 15 is a view showing a state in which an ice bucket is mounted in an ice-making compartment of a refrigerator according to another embodiment of the present disclosure.

FIG. 15 is a view showing a state in which an ice bucket is mounted in an ice-making compartment of a refrigerator according to another embodiment of the present disclosure.

A locking structure of the ice bucket of the refrigerator according to this embodiment will be described with reference to FIG. 15. A description of the same components of this embodiment as the previous embodiments may be omitted, such as the opening 543 corresponds to the opening 43 of the previous embodiments.

A first magnet mounting part 576 is provided at the upper end 575 of a cover 570 of the ice bucket 550. A first magnet 577 is mounted in the first magnet mounting part 576. At the rear 571 of the cover 570 of the ice bucket 550 may be provided a sealing member 572 to achieve airtightness with a front wall 542 of an ice-making compartment 540.

A second magnet mounting part 544 is provided at the front wall 542 of an ice-making compartment 540. In the second magnet mounting part 544 is mounted a second magnet 545 magnetically reacting with the first magnet 577.

That is, the locking structure of the ice bucket of the refrigerator according to this embodiment includes the first magnet 577 provided at the upper end 575 of the cover 570 of the ice bucket 550 and the second magnet 545, provided at the front wall 542 of the ice-making compartment 540, magnetically reacting with the first magnet 577.

Consequently, the locking structure of the ice bucket using magnetic forces may be achieved without an additional locking device provided at the inner liner ceiling.

Figure 16:
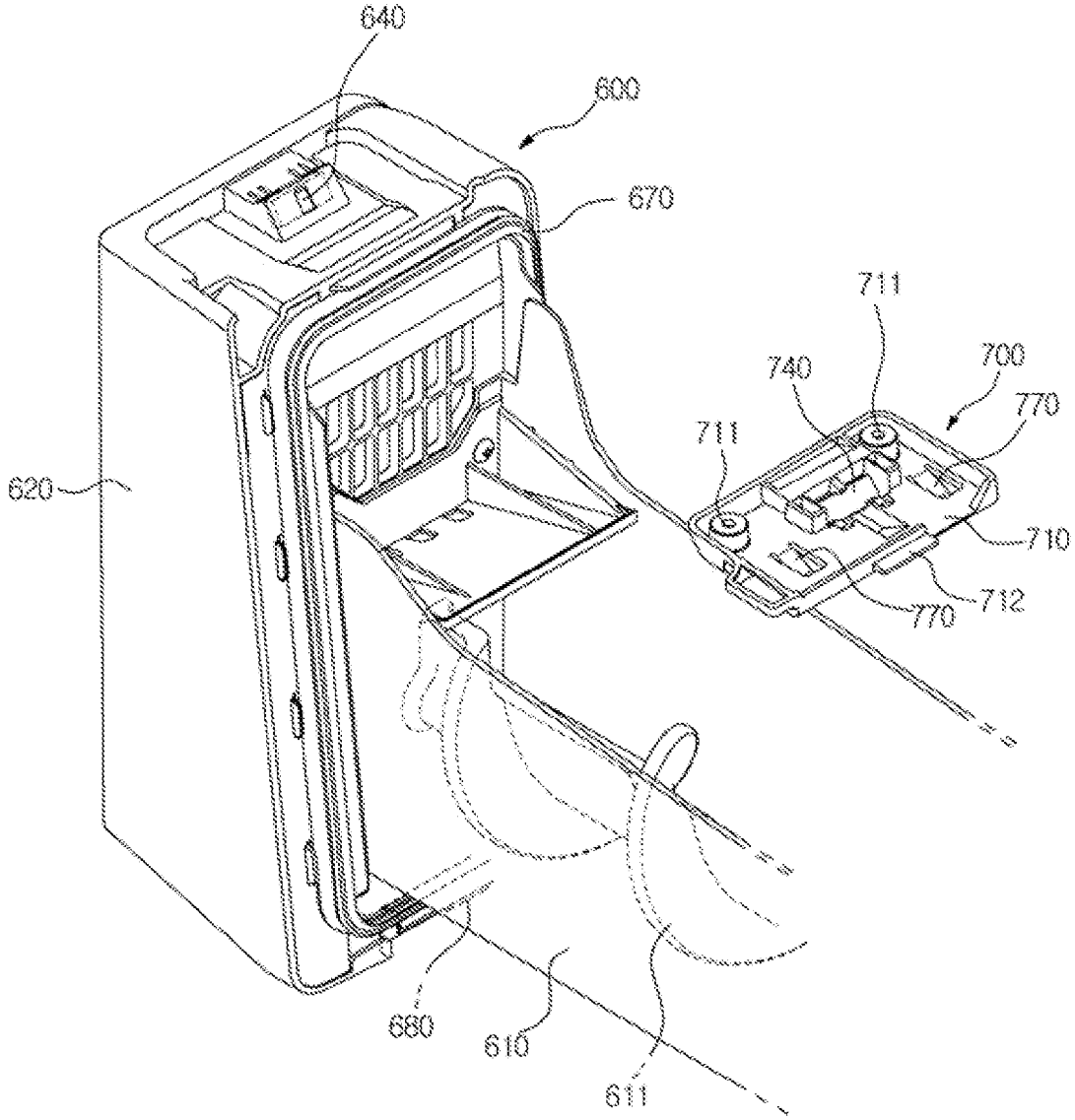
FIG. 16 is a perspective view showing an ice bucket and a locking device of a refrigerator according to a further embodiment of the present disclosure.
Figure 17:
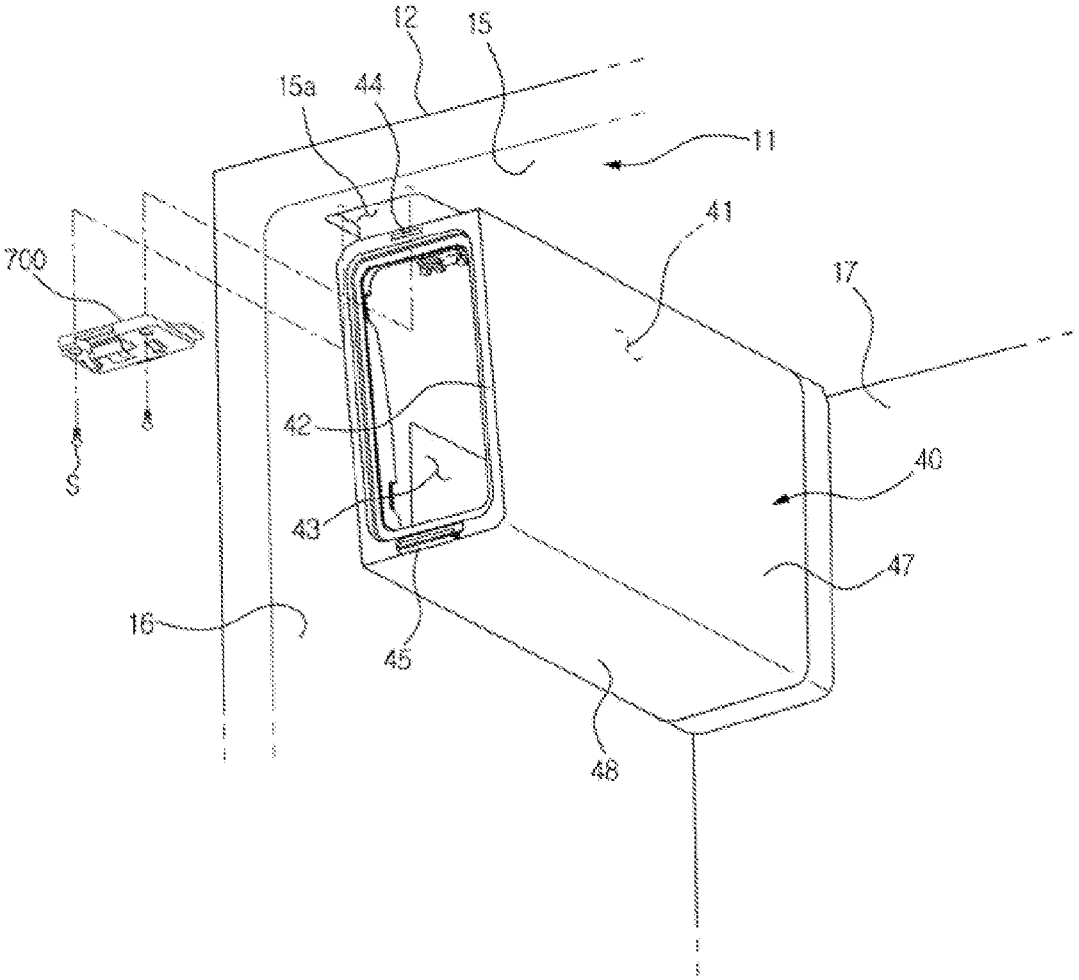
FIG. 17 is a view showing an installation structure of the locking device of FIG. 16.
Figure 18:
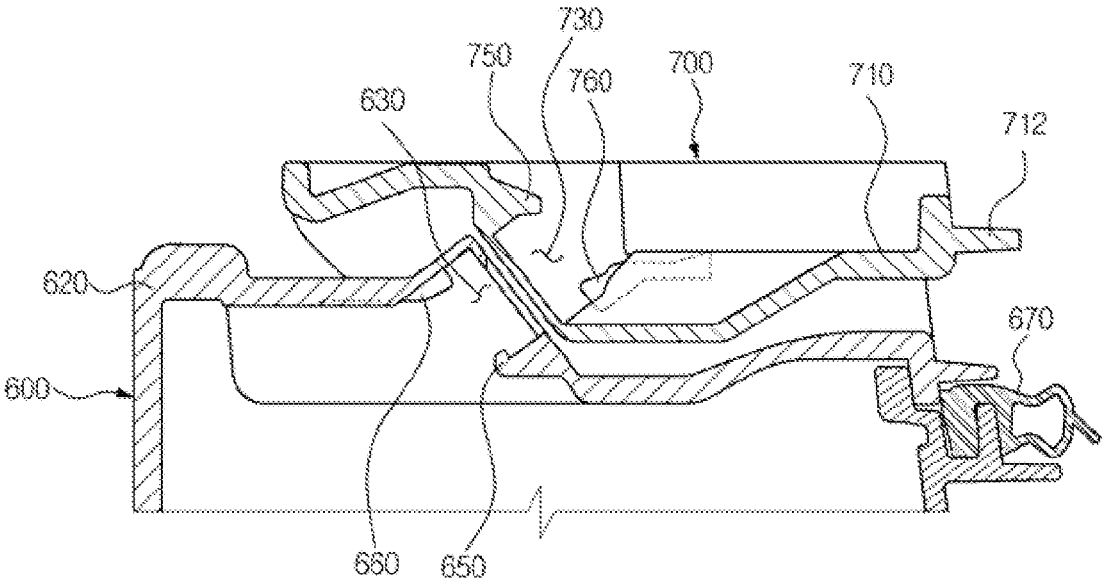
FIG. 18 is a view illustrating magnet receiving grooves provided at the ice bucket and the locking device of FIG. 16 with magnets omitted.
Figure 19:
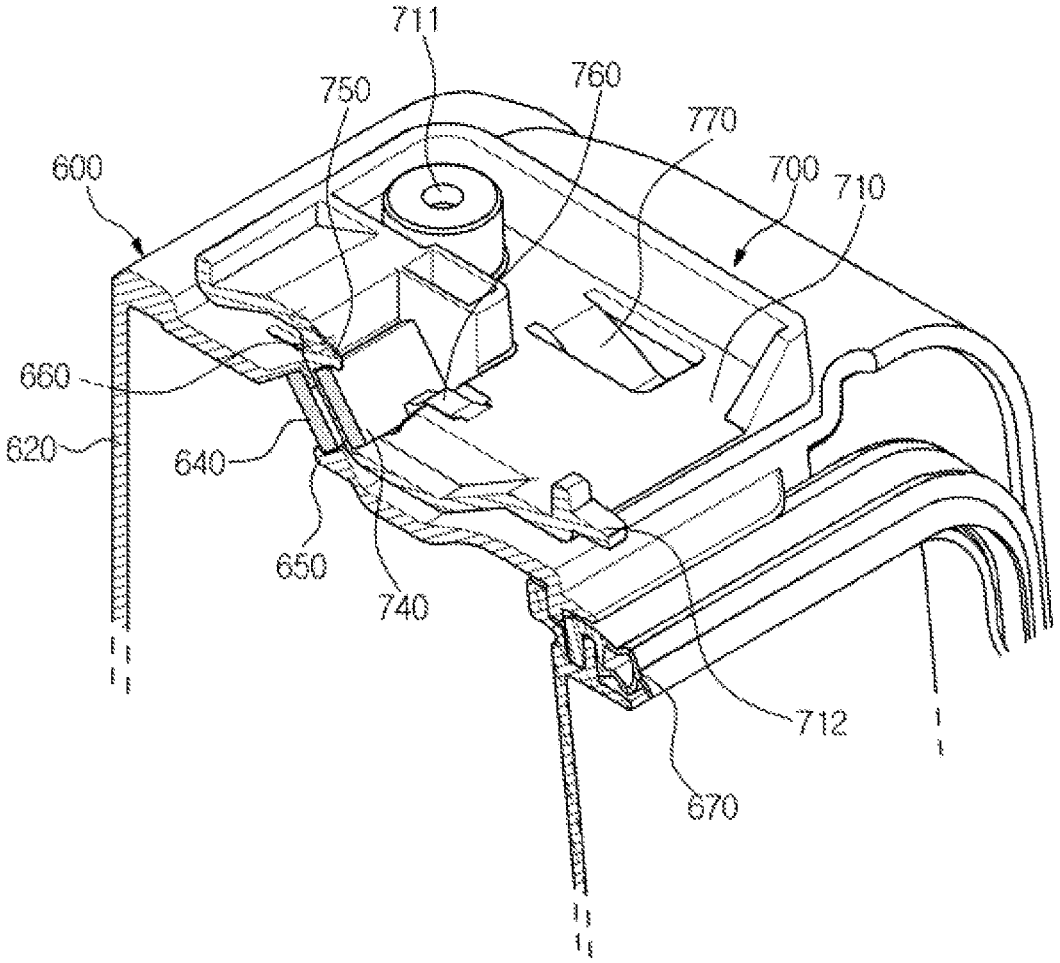
FIG. 19 is a partial sectional view of the ice bucket and the locking device of FIG. 16.
Figure 20:
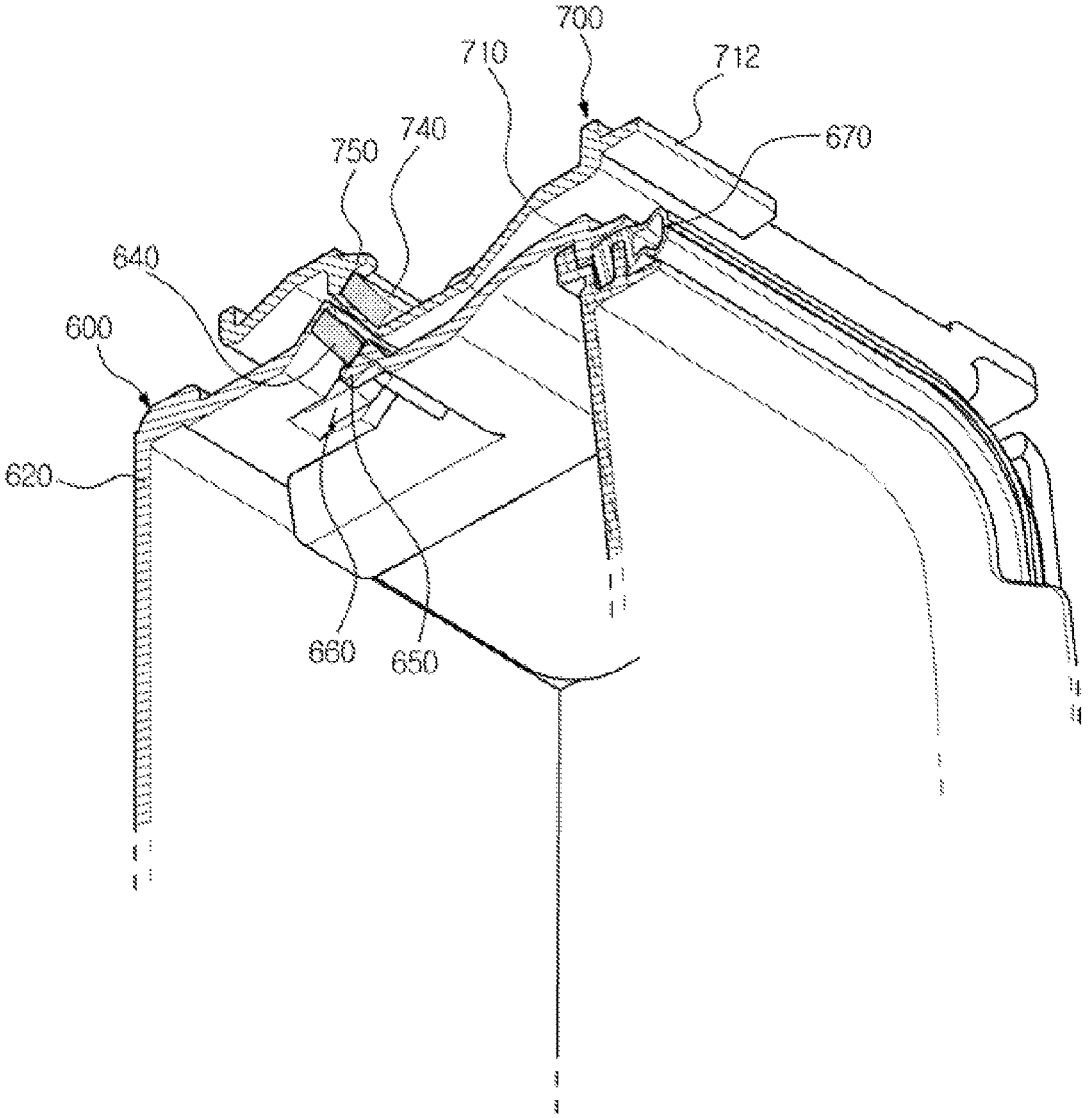
FIG. 20 is a partial sectional view of the ice bucket and the locking device of FIG. 16 when viewed in another direction.
Figure 21:
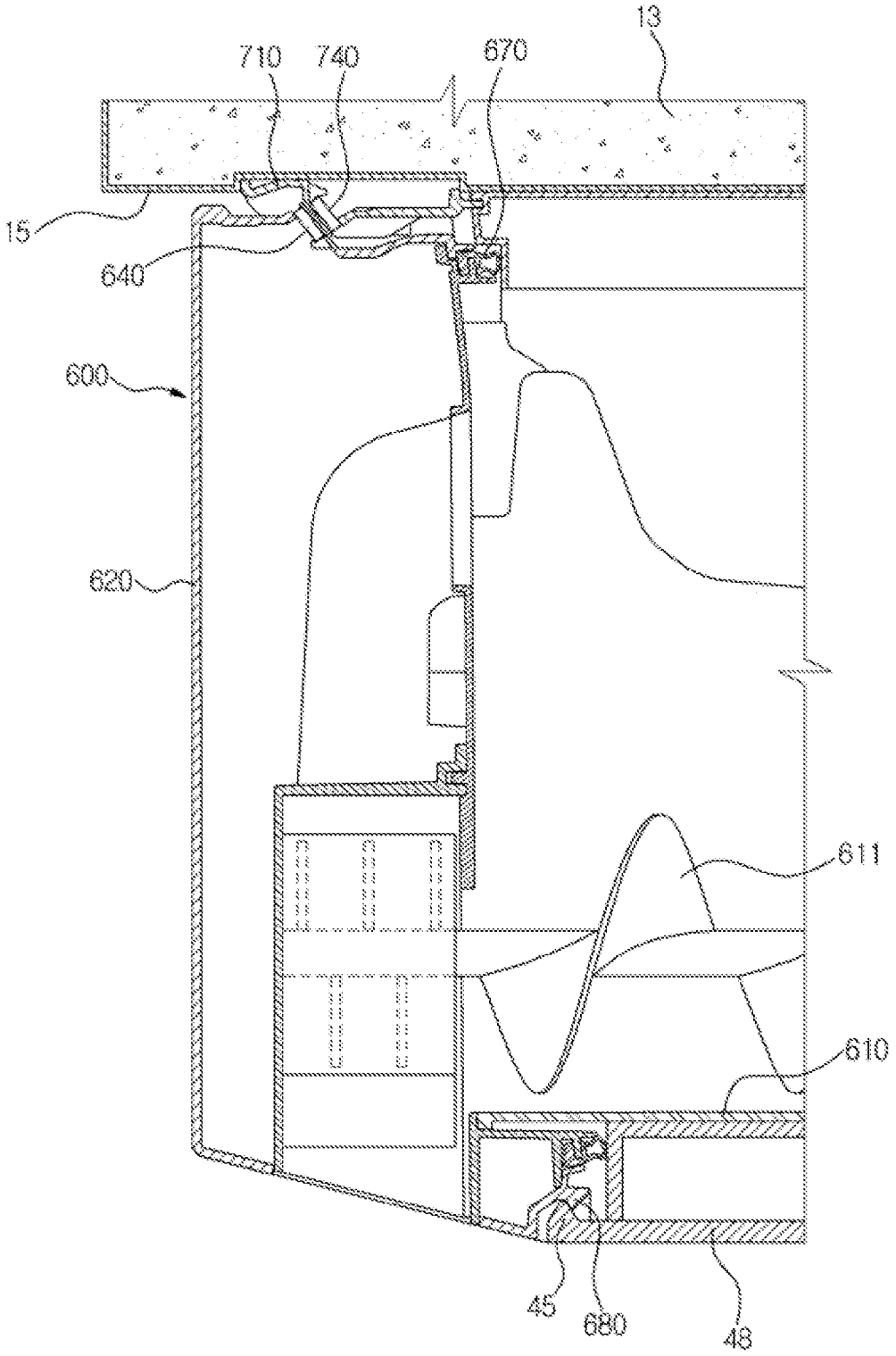
FIG. 21 is a sectional view showing a state in which the ice bucket of FIG. 16 is locked.
Figure 22:
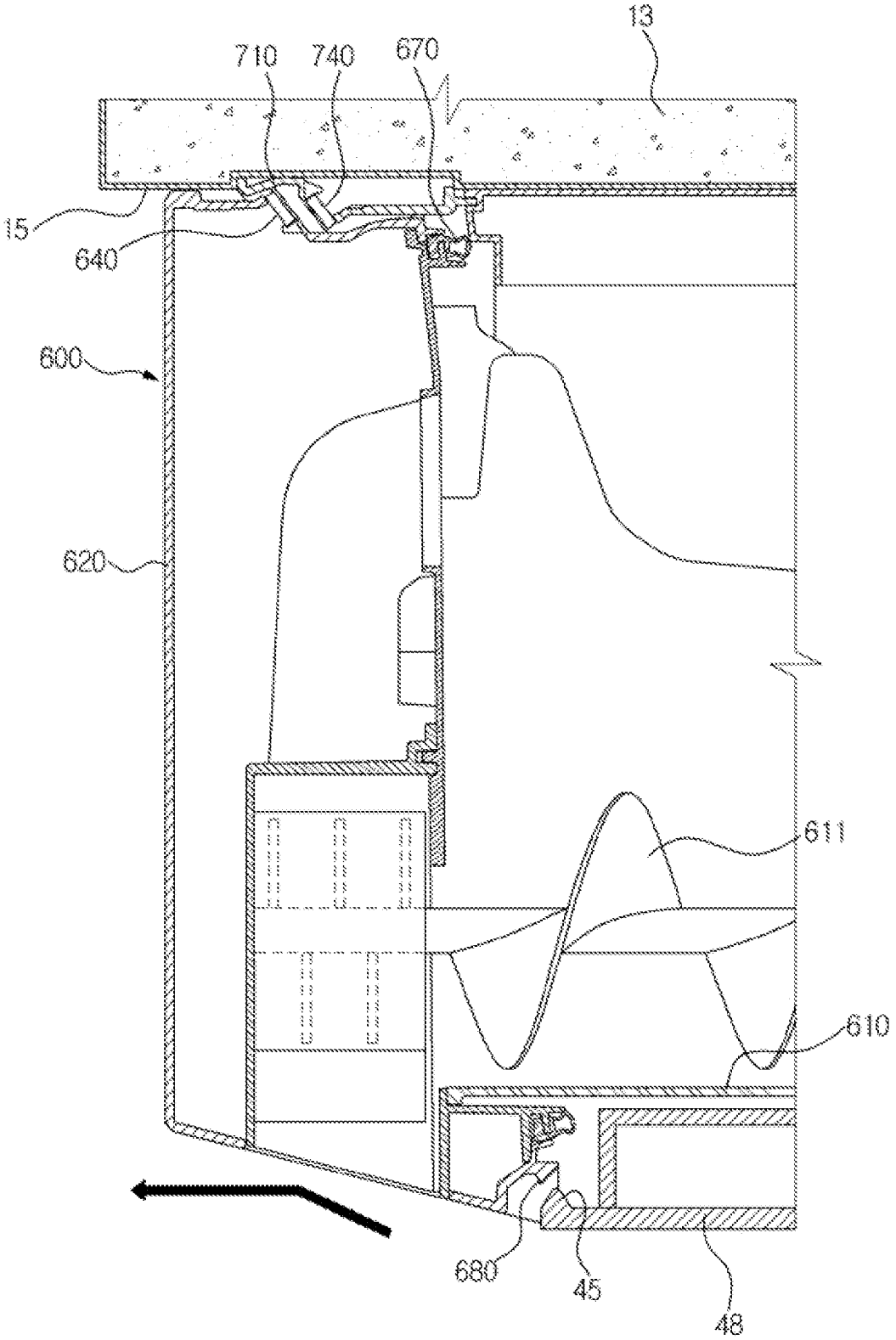
FIG. 22 is a sectional view illustrating operation of unlocking the ice bucket of FIG. 16.

FIG. 16 is a perspective view showing an ice bucket and a locking device of a refrigerator according to a further embodiment of the present disclosure, FIG. 17 is a view showing an installation structure of the locking device of FIG. 16, FIG. 18 is a view illustrating magnet receiving grooves provided at the ice bucket and the locking device of FIG. 16, FIG. 19 is a partial sectional view of the ice bucket and the locking device of FIG. 16, FIG. 20 is a partial sectional view of the ice bucket and the locking device of FIG. 16 when viewed in another direction, FIG. 21 is a sectional view showing a state in which the ice bucket of FIG. 16 is locked, and FIG. 22 is a sectional view illustrating operation of unlocking the ice bucket of FIG. 16. Magnets are omitted from FIG. 18.

A locking structure of the ice bucket according to this embodiment will be described with reference to FIGS. 16 to 22. The same components of this embodiment as the previous embodiments are denoted by the same reference numerals and a description thereof may be omitted.

The locking structure of the ice bucket according to this embodiment is more materialized than that according to previous embodiment of FIGS. 12 and 13.

That is, the locking structure of the ice bucket of the refrigerator according to this embodiment includes a first magnet 640 provided at the upper end of the ice bucket 600 and a second magnet 740 provided at the locking device 700 installed at the ceiling 15 of the inner liner 11 of the main body.

The ice bucket 600 is locked by magnetically attractive force between the first magnet 640 and the second magnet 740. The locked ice bucket 600 may be unlocked simply by withdrawing the ice bucket 600 while slightly lifting ice bucket 600 up without additional operation.

As shown in FIGS. 16 and 17, the ice bucket 600 includes a basket 610 to store ice and a cover 620 provided at the front of the basket 610 to close an opening 43 of an ice-making compartment 40 when the ice bucket 600 is introduced into the ice-making compartment 40.

In the basket 610 may be provided an auger 611 to convey ice received in the basket 610.

At the rear of the cover 620 may be provided a sealing member 670, made of rubber, contacting a front wall 42 of the ice-making compartment 40 to achieve airtightness. At the lower end of the rear of the cover 620 may be provided a lower protrusion 680 interfering with a catching protrusion 45 of the front wall 42 of the ice-making compartment 40 to physically fix the lower end of the ice bucket 600.

The first magnet 640 is mounted at the upper end of the cover 620 of the ice bucket 600. To this end, a first magnet receiving groove 630 (see FIG. 18), in which the first magnet 640 is received, is provided at the upper end of the cover 620 of the ice bucket 600.

The first magnet 640 is received and fixed in the first magnet receiving groove 630. To this end, the ice bucket 600 may be provided with a first magnet fixing hook 650 and a first magnet elastic hook 660.

The first magnet fixing hook 650 and the first magnet elastic hook 660 support the first magnet 640 such that the first magnet 640 is fixed in the first magnet receiving groove 630.

The first magnet elastic hook 660 is elastically deformed in a direction in which the first magnet elastic hook 660 is somewhat widened when the first magnet 640 is inserted into the first magnet receiving groove 630 and returns to the original position thereof to support the first magnet 640 when the first magnet 640 is fully inserted into the first magnet receiving groove 630.

Meanwhile, the locking device 700 includes a locking device housing 710, a screw fastening hole 711, provided at the locking device housing 710, through which the locking device housing 710 is coupled to the ceiling 15 of the inner liner 11 of the main body, an insertion protrusion 712 inserted into an insertion groove 44 of the front wall 42 of the ice-making compartment 40 to adjust the position of the locking device 700, and the second magnet 740 magnetically reacting with the first magnet 640.

Magnetic reaction means attractive force. The pole and type of the first magnet 640 and the second magnet 740 are not particularly restricted.

The locking device housing 710 may be coupled to the ceiling 15 of the inner liner 11 by inserting the insertion protrusion 712 into the insertion groove 44 of the front wall 42 of the ice-making compartment 40 to adjust the position of the locking device 700 and fastening a screw S into the screw fastening hole 711.

The second magnet 740 is mounted in a second magnet receiving groove 730 (see FIG. 18) provided at the locking device housing 710. The second magnet 740 is received and fixed in the second magnet receiving groove 730.

To this end, the locking device housing 710 may be provided with a second magnet fixing hook 750 and a second magnet elastic hook 760.

The second magnet fixing hook 750 and the second magnet elastic hook 760 support the second magnet 740 such that the second magnet 740 is fixed in the second magnet receiving groove 730.

The second magnet elastic hook 760 is elastically deformed in a direction in which the second magnet elastic hook 760 is somewhat widened when the second magnet 740 is inserted into the second magnet receiving groove 730 and returns to the original position thereof to support the second magnet 740 when the second magnet 740 is fully inserted into the second magnet receiving groove 730.

Meanwhile, the locking device housing 710 may be provided with at least one push rib 770 to push the ice bucket 600 downward, when the ice bucket 600 is inserted into the ice-making compartment 40, to further increase fixing force of the ice bucket 600. The push rib 770 may protrude downward from the locking device housing 710. The push rib 770 may be formed of an elastic material.

Locking and unlocking of the ice bucket 600 according to this embodiment will be described with reference to FIGS. 21 and 22.

Locking of the ice bucket 600 may be achieved simply by inserting the ice bucket 600 into the ice-making compartment 40. At this time, the ice bucket 600 may be inserted into the ice-making compartment 40 while being slightly lifted up such that the lower protrusion 680 of the cover 620 of the ice bucket 600 is not interfered with by the catching protrusion 45 of the ice-making compartment 40.

When insertion of the ice bucket 600 is completed, as shown in FIG. 21, the ice bucket 600 may be locked by magnetically attractive force between the first magnet 640 provided at the upper end of the cover 620 of the ice bucket 600 and the second magnet 740 of the locking device 700.

In addition, the lower protrusion 680 of the ice bucket 600 may be interfered with by the catching protrusion 45 of the ice-making compartment 40 such that the lower end of the ice bucket 600 is physically fixed.

Furthermore, the push rib 770 of the locking device 700 may push the ice bucket 600 downward such that the entirety of the ice bucket 600 comes into tight contact with the ice-making compartment bottom wall 48. Consequently, the ice bucket 600 may be more strongly fixed.

As shown in FIG. 22, unlocking of the ice bucket 600 may be easily achieved simply by withdrawing the ice bucket 600. That is, unlocking of the ice bucket 600 is not different from withdrawal of the ice bucket 600. When the ice bucket 600 is withdrawn, the ice bucket 600 is also unlocked.

At this time, the ice bucket 600 may be inserted into the ice-making compartment 40 while being slightly lifted up such that the lower protrusion 680 of the ice bucket 600 is not interfered with by the catching protrusion 45 of the ice-making compartment 40. As a result, the ice bucket 600 may be unlocked and, at the same time, withdrawn.

In order to unlock the ice bucket 600, it may be necessary to withdraw the ice bucket 600 using force greater than the magnetically attractive force between the first magnet 640 and the second magnet 740.

In the fixing structure of the ice bucket using the conventional latch mechanism, only the movement of the ice bucket is restricted as previously described. On the other hand, the locking device of the ice bucket using the magnetic forces of the magnets according to the embodiment of the present disclosure restricts movement of the ice bucket 600 in all directions and, in addition, enables the ice bucket 600 to be in tight contact with the ice-making compartment 40, thereby fundamentally preventing leakage of cool air from the ice-making compartment 40.

Furthermore, when the ice bucket 600 is unlocked and withdrawn, the latch or the button is released and then the ice bucket 600 is withdrawn while being lifted up in the conventional latch mechanism or the structures of the embodiment of FIGS. 1 to 9 and the embodiment of FIGS. 10 and 11 using the button. In the fixing structure using the magnetic forces of the magnet according to the other embodiments of the present disclosure, however, the ice bucket 600 is unlocked when the ice bucket 600 is withdrawn while being lifted up, thereby improving user convenience.

As is apparent from the above description, according to embodiments of the present disclosure, the cover of the ice bucket is in tight contact with the ice-making compartment due to the magnetic forces of the magnets, thereby fundamentally preventing leakage of cool air from the ice-making compartment and improving reliability.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A refrigerator comprising:

a main body having an inner liner and an outer liner;

an ice-making compartment formed in the main body, the ice-making compartment having an opening formed at a front thereof;

an ice bucket inserted into or withdrawn from the ice-making compartment through the opening, the ice bucket having a cover to cover the opening to prevent leakage of cool air from the ice-making compartment;

a first magnet provided at an upper end of the cover;

a button member, at which a second magnet is mounted such that the second magnet magnetically reacts with the first magnet, the button member being provided at a ceiling of the inner liner such that the button member is movable between a closed position and an open position; and an elastic member to elastically bias the button member to the closed position, wherein the first magnet and the second magnet each comprise at least one N pole and at least one S pole alternately arranged in a movement direction of the button member, the N pole of the first magnet faces the S pole of the second magnet and the S pole of the first magnet faces the N pole of the second magnet at the closed position such that attractive force is generated between the first magnet and the second magnet, the N pole of the first magnet faces the N pole of the second magnet and the S pole of the first magnet faces the S pole of the second magnet at the open position such that repulsive force is generated between the first magnet and the second magnet, and the button member includes a push protrusion formed below the second magnet, the push protrusion including an inclined surface that separates the second magnet from the first magnet in a direction perpendicular to the movement direction according to movement of the button member whereby the repulsive force is supplemented by a mechanical force when moving from the closed position to the open position.

2. The refrigerator according to claim 1, further comprising a locking device housing to receive the button member and the elastic member, the locking device housing being coupled to the ceiling of the inner liner.

3. The refrigerator according to claim 2, wherein the locking device housing comprises a first housing coupled to the ceiling of the inner liner and a second housing coupled to the first housing.

4. The refrigerator according to claim 1, wherein the cover has a first magnet mounting part, in which the first magnet is mounted.

5. The refrigerator according to claim 1, wherein the button member has a second magnet mounting part, in which the second magnet is mounted.

6. The refrigerator according to claim 1, wherein the first magnet and the second magnet are inclined.

7. The refrigerator according to claim 1, wherein the first magnet and the second magnet are permanent magnets.

8. The refrigerator according to claim 1, wherein the cover is provided at a rear thereof with a sealing member, made of rubber, contacting the ice-making compartment to achieve airtightness.

9. A refrigerator comprising:

a main body having an inner liner and an outer liner;

an ice-making compartment formed in the main body, the ice-making compartment having an opening formed at a front thereof;

an ice bucket inserted into or withdrawn from the ice-making compartment through the opening, the ice bucket having a cover to cover the opening to prevent leakage of cool air from the ice-making compartment;

a first magnet provided at an upper end of the cover;

a button member, at which a second magnet is mounted such that attractive force is generated between the first magnet and the second magnet, the button member being provided at a ceiling of the inner liner such that the button member is movable between a closed position at which the second magnet is the closest to the first magnet such that attractive force between the first magnet and the second magnet is maximized and an open position at which the second magnet is the farthest from the first magnet such the attractive force between the first magnet and the second magnet is minimized; and an elastic member to elastically bias the button member to the closed position, wherein the first magnet and the second magnet each comprise N and S poles arranged in a direction perpendicular to a movement direction of the button member and the first magnet and the second magnet are disposed such that opposite poles of the first magnet and the second magnet face each other, and the button member includes a push protrusion formed below the second magnet, the push protrusion including an inclined surface that separates the second magnet from the first magnet in a direction perpendicular to the movement direction according to movement of the button member whereby the minimized attractive force force is supplemented by a mechanical force when moving from the closed position to the open position.

* * * * *